US009289983B2

(12) United States Patent
Nitta et al.

(10) Patent No.: US 9,289,983 B2
(45) Date of Patent: Mar. 22, 2016

(54) INK JET HEAD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Noboru Nitta, Kannami Tagata Shizuoka (JP); Teruyuki Hiyoshi, Izunokuni Shizuoka (JP); Shunichi Ono, Izu Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/713,324

(22) Filed: May 15, 2015

(65) Prior Publication Data

US 2015/0328887 A1 Nov. 19, 2015

(30) Foreign Application Priority Data

May 19, 2014 (JP) ..... 2014-103533
Mar. 25, 2015 (JP) ..... 2015-063335

(51) Int. Cl.
*B41J 29/393* (2006.01)
*B41J 2/045* (2006.01)

(52) U.S. Cl.
CPC ..... *B41J 2/04588* (2013.01); *B41J 2/04581* (2013.01); *B41J 2/04586* (2013.01); *B41J 2/04591* (2013.01)

(58) Field of Classification Search
CPC ..... B41J 2/04581; B41J 2/04588; B41J 2/04586; B41J 2/04591
USPC ..... 347/11, 69
See application file for complete search history.

(56) References Cited

U.S. PATENT DOCUMENTS

| | | | | |
|---|---|---|---|---|
| 6,504,701 | B1 | 1/2003 | Takamura et al. | |
| 2010/0007704 | A1 | 1/2010 | Nitta | |
| 2012/0146451 | A1 | 6/2012 | Nitta | |
| 2012/0147075 | A1 | 6/2012 | Hiyoshi et al. | |
| 2013/0241349 | A1 | 9/2013 | Nitta | |
| 2014/0111570 | A1 | 4/2014 | Nitta et al. | |
| 2014/0176627 | A1 | 6/2014 | Ono et al. | |
| 2014/0240383 | A1 * | 8/2014 | Penberth | H01L 41/042 347/10 |
| 2014/0246952 | A1 | 9/2014 | Nitta | |

* cited by examiner

*Primary Examiner* — Julian Huffman
(74) *Attorney, Agent, or Firm* — Amin, Turocy & Watson, LLP

(57) ABSTRACT

When charging an actuator, first, the charging is performed by applying an intermediate voltage lower than a driving voltage which is a target voltage and then charging is performed by applying the driving voltage to the actuator. When discharging the actuator, the discharging is performed by applying the intermediate voltage and then the discharging is performed by applying a zero voltage to the actuator which is charged by the driving voltage. The time for applying the intermediate voltage at a timing of ejecting the ink from the nozzles is shorter than the time for applying the intermediate voltage to the actuator at other timings.

8 Claims, 24 Drawing Sheets

FIG. 23

| START TRIGGER | STATE | DRIVING PATTERN DATA | | | | | | EJECTION OPERATION |
|---|---|---|---|---|---|---|---|---|
| | | S11(-) | S12(+) | S13(0) | S21(-) | S22(+) | S23(0) | |
| | st0 | off | off | ON | off | off | ON | |
| 1 | st1 | off | ON | off | off | off | ON | TD REPLENISHMENT |
| 0 | st2 | off | ON | off | ON | off | off | |
| 0 | st3 | off | ON | off | off | off | ON | TR EJECTION |
| 0 | st4 | off | off | ON | off | off | ON | |
| 0 | st5 | off | off | ON | off | ON | off | |
| 0 | st6 | ON | off | off | off | ON | off | TP DAMPING |
| 0 | st7 | off | off | ON | off | ON | off | |
| 0 | st0 | off | off | ON | off | off | ON | |

TIME ELAPSE

INK JET HEAD

CROSS-REFERENCE TO RELATED APPLICATION

This application is based upon and claims the benefit of priority from Japanese Patent Application No. 2014-103533, filed May 19, 2014 and Japanese Patent Application No. 2015-063335, filed Mar. 25, 2015, the entire contents of which are incorporated herein by reference.

FIELD

Embodiments described herein relate generally to an ink jet head including capacitive-type actuators.

BACKGROUND

An ink jet head including a plurality of ejection channels includes a number of piezoelectric elements which are capacitive-type actuators, as actuators for ejecting ink from each channel.

In the related art, as a method of generating a driving waveform for driving the piezoelectric elements, a method of switching a voltage to be applied to the channels with switches by providing a plurality of switches for each channel and generating a desired waveform in units of the channel is known. However, this method may lead to great power consumption, when an attempt is made to obtain sufficient ejecting speed.

DESCRIPTION OF THE DRAWINGS

FIG. 23 is a diagram showing a specific example of driving pattern data stored in a driving pattern memory in the second embodiment.

DETAILED DESCRIPTION

An object of the exemplary embodiment is to provide an ink jet head having low power consumption while maintaining a sufficient ejecting speed of ink.

In one embodiment, an ink jet head includes a pressure chamber which is filled with ink, capacitive-type actuators, nozzles, a charging and discharging circuit, and a waveform generation circuit. The actuators change volume of the pressure chamber by performing charging or discharging with a series of charging and discharging sequences. The nozzles eject ink in the pressure chamber according to the change of the volume of the pressure chamber. The charging and discharging circuit selectively charges or discharges the actuator depending on the input driving waveform. The waveform generation circuit outputs a driving waveform to the charging and discharging circuit so as to perform charging by applying an intermediate voltage and then perform charging by applying a driving voltage to the actuators, when charging the actuators, and perform discharging by applying an intermediate voltage and then perform discharging by applying a zero voltage to the actuator which is charged by the driving voltage, when discharging the actuator. The time for applying the intermediate voltage to the actuator at a timing of ejecting the ink from the nozzles is shorter than the time for applying the intermediate voltage to the actuator at other timings.

Hereinafter, exemplary embodiments of the ink jet head having optimal ejecting characteristics will be described with reference to the drawings.

In the exemplary embodiments, an ink jet printer 200 (see FIG. 5) using a share mode type ink jet head 100 (see FIG. 1) is used as an example.

Figure 1:
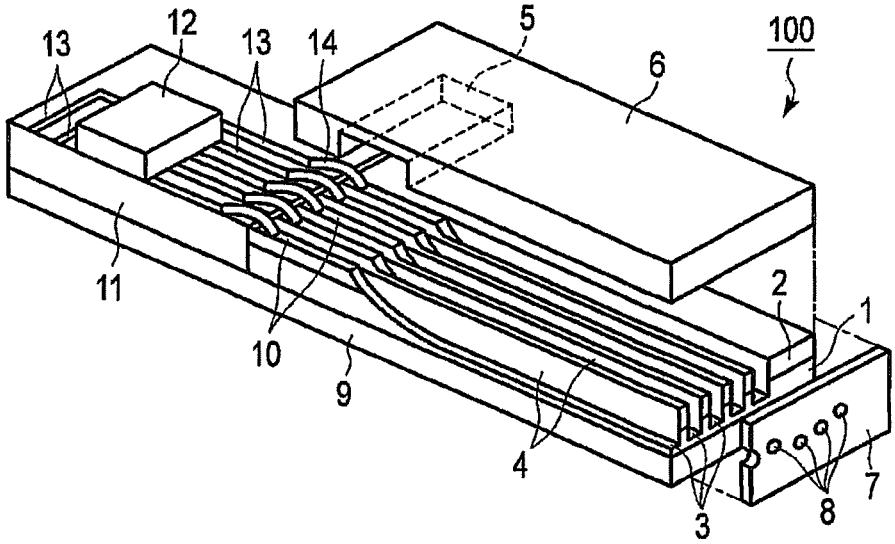
FIG. 1 is a perspective view showing an exploded part of an ink jet head.
Figure 2:
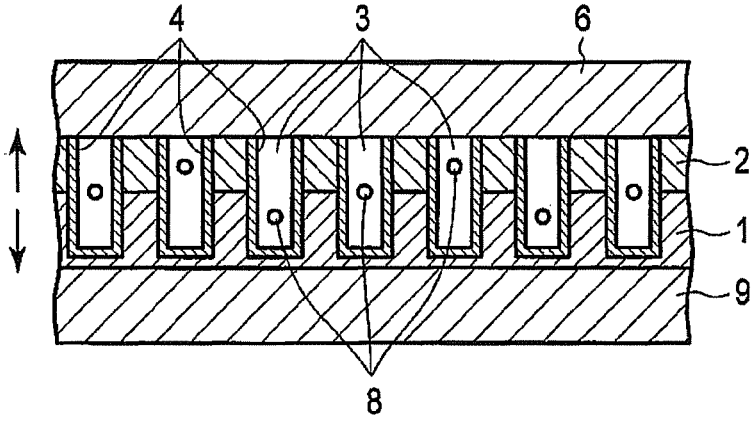
FIG. 2 is a transverse sectional view of a front part of the ink jet head.
Figure 3:
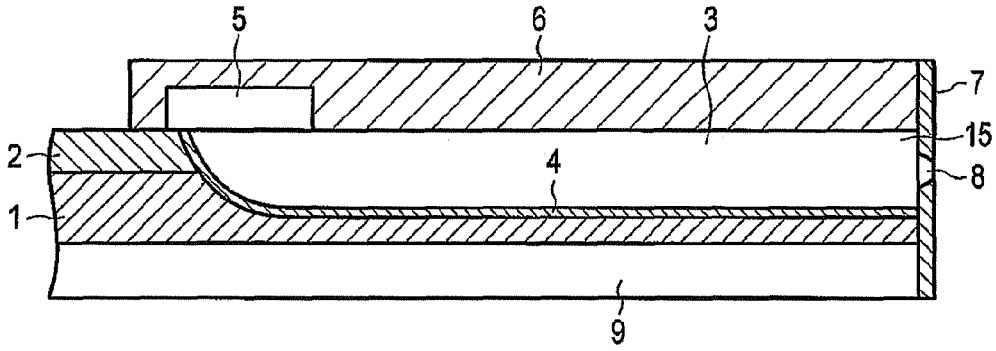
FIG. 3 is a longitudinal sectional view of a front part of the ink jet head.

First, a configuration of the ink jet head 100 (hereinafter, abbreviated as a head 100) will be described with reference to FIGS. 1 to 3. FIG. 1 is a perspective view showing an exploded part of the head 100, FIG. 2 is a transverse sectional view of a front part of the head 100, and FIG. 3 is a longitudinal sectional view of a front part of the head 100.

The head 100 includes a base substrate 9. In the head 100, a first piezoelectric member 1 is bonded to an upper surface of the base substrate 9 on a front side and a second piezoelectric member 2 is bonded to the upper portion of the first piezoelectric member 1. As shown with arrows in FIG. 2, the bonded first piezoelectric member 1 and the second piezoelectric member 2 are polarized in an opposite direction to each other along a substrate thickness direction.

The base substrate 9 is formed using a material having a small dielectric constant and a small difference in coefficients of thermal expansion between the piezoelectric members 1 and 2. As materials of the base substrate 9, alumina ($Al_2O_3$), silicon nitride ($Si_3N_4$), silicon carbide (SiC), aluminum nitride (AlN), lead zirconate titanate (PZT), and the like are preferable. Meanwhile, as materials of the piezoelectric members 1 and 2, lead zirconate titanate (PZT), lithium niobate ($LiNbO_3$), lithium tantalate ($LiTaO_3$), and the like are used.

The head 100 includes a number of longitudinal grooves 3 from a front end side to a rear end side of the bonded piezoelectric members 1 and 2. The grooves 3 have a constant space and are parallel to each other. A front end of each groove 3 is opened and a rear end thereof is inclined upwards.

The head 100 includes electrodes 4 on a side wall and a bottom surface of each groove 3. The electrodes 4 have a two-layer structure of nickel (Ni) and gold (Au). The electrodes 4 are evenly formed in each groove 3 by a plating method, for example. The method of forming the electrodes 4 is not limited to the plating method. A sputtering method, a vapor-deposition method, or the like can also be used.

The head 100 includes extraction electrodes 10 from the rear end of each groove 3 to the upper surface of the rear portion of the second piezoelectric member 2. The extraction electrodes 10 extend from the electrodes 4.

The head 100 includes a ceiling 6 and an orifice plate 7. The ceiling 6 covers the upper portion of the grooves 3. The orifice plate 7 covers the front end of the grooves 3. The head 100 forms a plurality of pressure chambers 15 with the grooves 3 surrounded by the ceiling 6 and the orifice plate 7. The pressure chambers 15, for example, have a shape with a depth of 300 μm, length of 1200 μm and a width of 80 μm and are arranged in parallel at a pitch of 169 μm. Such pressure chambers 15 are also referred to as ink chambers.

The ceiling 6 includes a common ink chamber 5 at the rear side therein. On the orifice plate 7, nozzles 8 are provided by performing punching at positions facing the grooves 3. The nozzles 8 are connected to the facing grooves 3, that is, the pressure chambers 15. The nozzle 8 has a taper shape from the pressure chamber 15 side to an ink ejecting side at the opposite side thereof. The nozzles 8 corresponding to three pressure chambers 15 adjacent to each other are set as 1 set and are formed at constant intervals in a height direction of the grooves 3 (vertical direction of plane of paper of FIG. 2).

In the head 100, a printed circuit board 11 having conductive patterns 13 formed thereon is bonded to the upper surface of the base substrate 9 on the rear side. In the head 100, a drive IC 12 including a head driving circuit 101 which will be described later and is mounted thereon, is loaded on the printed circuit board 11. The drive IC 12 is connected to the conductive pattern 13. The conductive patterns 13 are combined with the extraction electrodes 10 using conductive wires 14 by wire bonding.

In general, a set of the pressure chamber 15, the electrode 4, and the nozzle 8 included in the head 100 is referred to as a channel. That is, the head 100 includes channels Ch. 1, Ch. 2, . . . , Ch. n by the number n of the grooves 3.

Next, an operation principle of the head 100 configured as described above will be described with reference to FIGS. 4A to 4C.

Figure 4A:
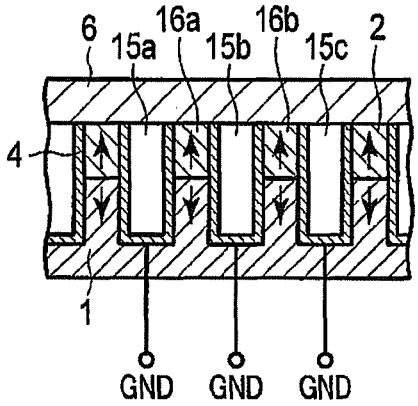
FIGS. 4A to 4C are diagrams illustrating an operation principle of the ink jet head.

FIG. 4A shows a state where all potentials of the electrodes 4 respectively disposed on each wall surface of a middle pressure chamber 15*b* and pressure chambers 15*a* and 15*c* at both sides adjacent to the pressure chamber 15*b* are ground potential GND. In this state, no deformation occurs on a partition wall 16*a* interposed between the pressure chamber 15*a* and the pressure chamber 15*b* and a partition wall 16*b* interposed between the pressure chamber 15*b* and the pressure chamber 15*c*.

Figure 4B:
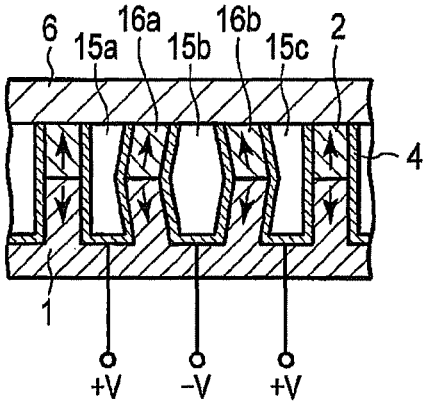

FIG. 4B shows a state where a negative polarity voltage −V is applied to the electrode 4 of the middle pressure chamber 15*b* and a positive polarity voltage +V is applied to the electrodes 4 of both neighboring pressure chamber 15*a* and pressure chamber 15*c*. In this state, an electric field which is double the voltage V is applied to the partition walls 16*a* and 16*b* in a direction orthogonal to the polarization direction of the piezoelectric members 1 and 2. By performing this operation, each of the partition walls 16*a* and 16*b* is deformed to the outer side so as to expand the volume of the pressure chamber 15*b*.

Figure 4C:
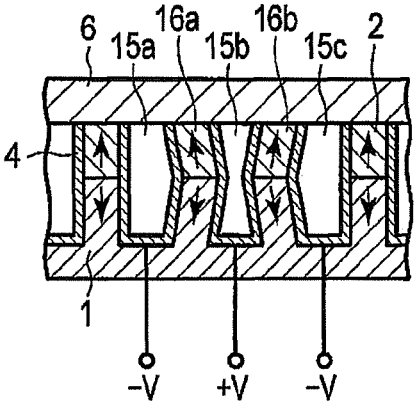

FIG. 4C shows a state where the positive polarity voltage +V is applied to the electrode 4 of the middle pressure chamber 15*b* and the negative polarity voltage −V is applied to the electrodes 4 of both neighboring pressure chamber 15*a* and pressure chamber 15*c*. In this state, an electric field which is double the voltage V is applied to the partition walls 16*a* and 16*b* in an opposite direction compared to a state of FIG. 4B. By performing this operation, each of the partition walls 16*a* and 16*b* is deformed to the inner side so as to contract the volume of the pressure chamber 15*b*.

When the capacitance of the pressure chamber 15*b* is expanded or contracted, pressure fluctuation occurs in the pressure chamber 15*b*. Due to this pressure fluctuation, the pressure in the pressure chamber 15*b* increases and ink droplets are ejected from the nozzles 8 which are connected to the pressure chamber 15*b*.

As described above, the partition walls 16*a* and 16*b* partitioning the pressure chambers 15*a*, 15*b*, and 15*c* are set as actuators for applying pressure fluctuation to the inside of the pressure chamber 15*b* having the partition walls 16*a* and 16*b* as wall surfaces. That is, each pressure chamber 15 shares the actuator with the neighboring pressure chambers 15. Accordingly, it is difficult for the head driving circuit 101 to independently drive the pressure chambers 15. The head driving circuit 101 drives the pressure chambers 15 by dividing the pressure chambers 15 into (n+1) groups by n (n is an integer equal to or greater than 2) pressure chambers. In the embodiment, a case where the head driving circuit 101 performs division driving by dividing the pressure chambers 15 into three sets by two pressure chambers, which is so-called three-division driving, is exemplified. The three-division driving is merely an example, and four-division driving or five-division driving may be performed.

Figure 5:
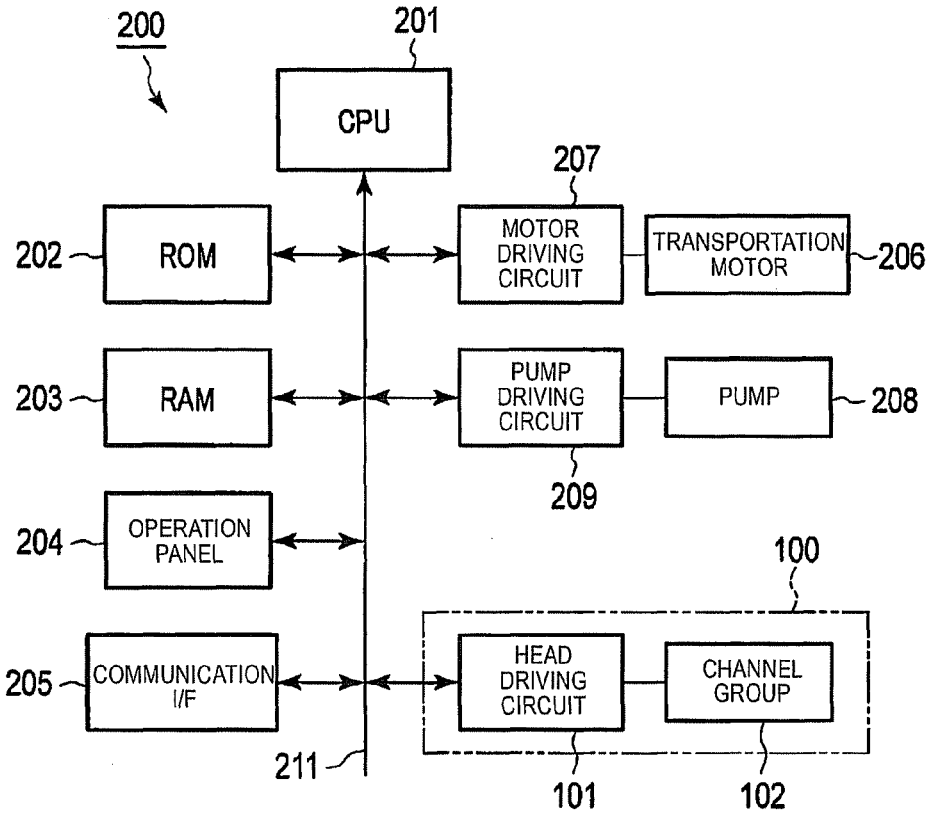
FIG. 5 is a block diagram showing a hardware configuration of an ink jet printer.
Figure 6A:
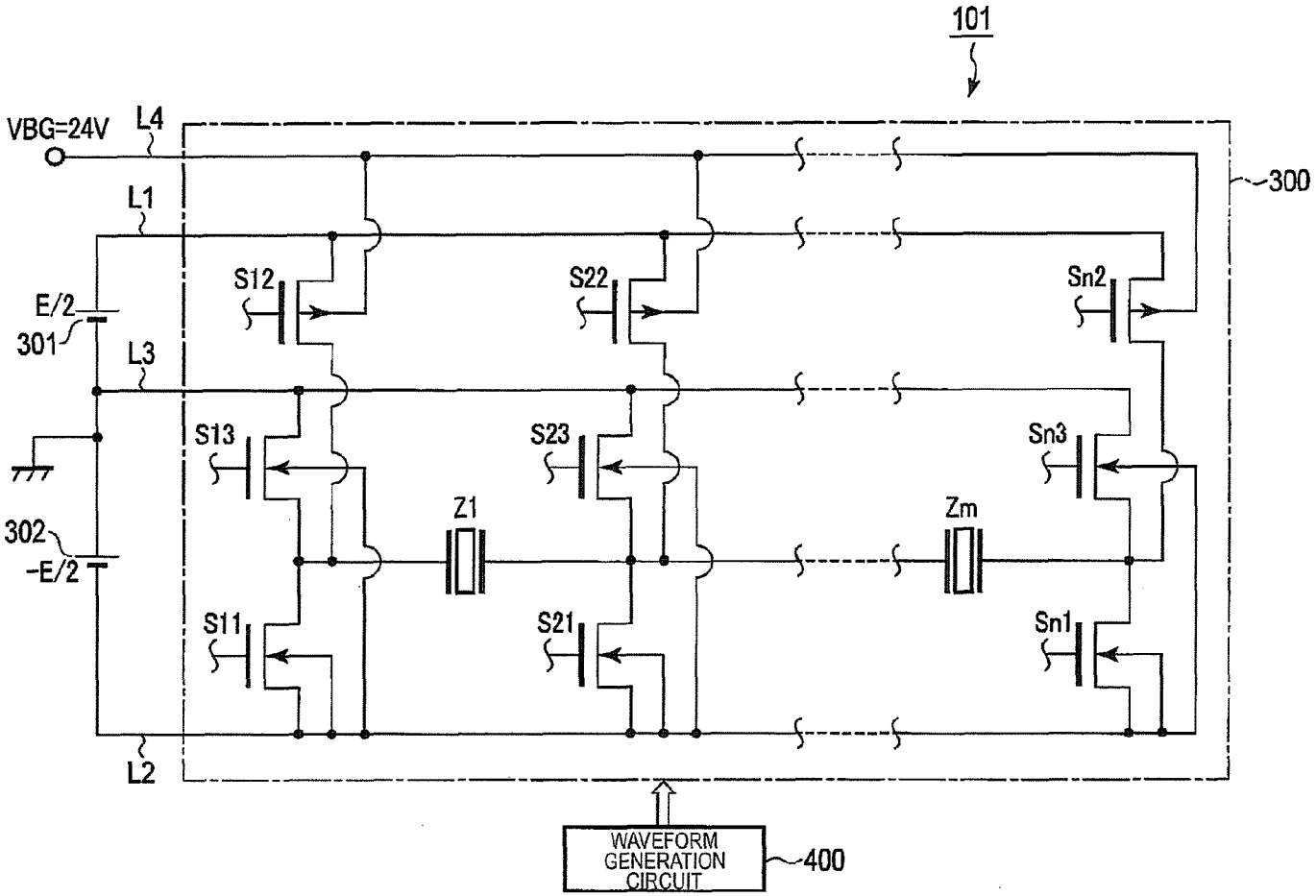
FIG. 6A is a circuit diagram showing a configuration of a head driving circuit included in the ink jet printer.
Figure 6B:
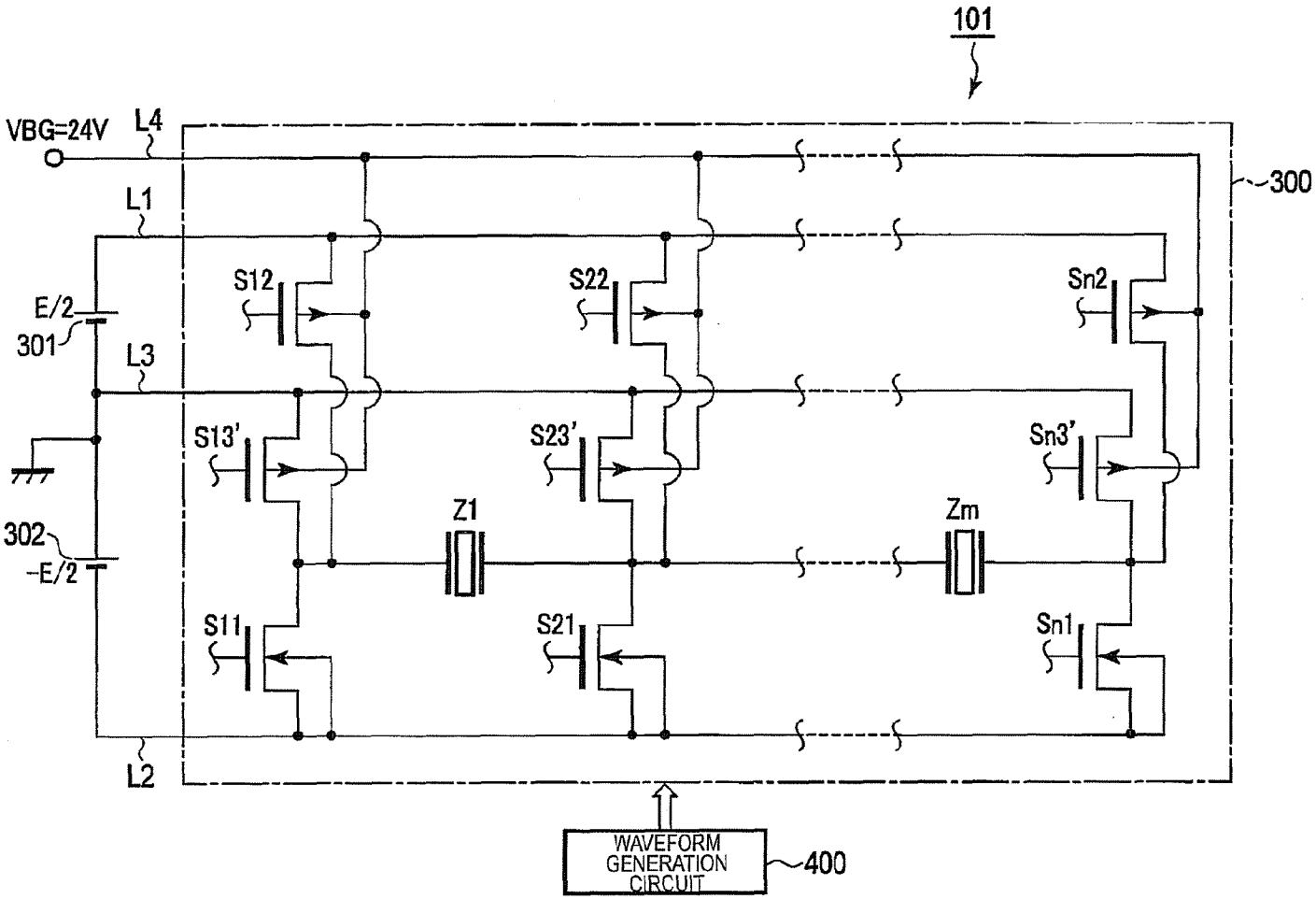
FIG. 6B is a circuit diagram showing another configuration of a head driving circuit included in the ink jet printer.

Next, a configuration of the ink jet printer 200 (hereinafter, abbreviated as a printer 200) will be described with reference to FIGS. 5, 6A, and 6B. FIG. 5 is a block diagram showing a hardware configuration of the printer 200, and FIGS. 6A and 6B are circuit diagrams showing a configuration of the head driving circuit 101 included in the printer 200.

The printer 200 includes a central processing unit (CPU) 201, a read only memory (ROM) 202, a random access memory (RAM) 203, an operation panel 204, a communication interface 205, a transportation motor 206, a motor driving circuit 207, a pump 208, a pump driving circuit 209, and the head 100. The printer 200 includes a bus line 211 such as an address bus or a data bus. In the printer 200, the CPU 201, the ROM 202, the RAM 203, the operation panel 204, the communication interface 205, the motor driving circuit 207, the pump driving circuit 209, and the driving circuit 101 of the head 100 are connected to the bus line 211 directly or through an input and output circuit.

The CPU 201 corresponds to a central part of a computer. The CPU 201 controls each unit in order to realize various functions as the printer 200, according to an operating system or an application program.

The ROM 202 corresponds to a main memory part of the computer. The ROM 202 stores the operating system or the application program. The ROM 202 may store data necessary for the CPU 201 to execute a process for controlling each unit.

The RAM 203 corresponds to a main memory part of the computer. The RAM 203 stores data necessary for the CPU 201 to execute the process. The RAM 203 is also used as a work area where information is suitably rewritten by the CPU 201. The work area includes an image memory in which printing data is expanded.

The operation panel 204 includes an operation unit and a display unit. The operation unit is a unit where function keys such as a power key, a paper feed key, an error release key, and the like are disposed. The display unit can display various states of the printer 200.

The communication interface 205 receives printing data from a client terminal connected through a network such as a local area network (LAN). When an error occurs in the printer 200, for example, the communication interface 205 transmits a signal for notifying an error to the client terminal.

The motor driving circuit 207 controls the driving of the transportation motor 206. The transportation motor 206 functions as driving power of a transportation mechanism for transporting a recording medium such as a printing sheet. When the transportation motor 206 is activated, the transportation mechanism starts transportation of a recording medium. The transportation mechanism transports the recording medium to a printing position by the head 100. The transportation mechanism ejects the printed recording medium to the outside of the printer 200 from an outlet (not shown).

The pump driving circuit 209 controls the driving of the pump 208. When driving the pump 208, the ink in an ink tank (not shown) is supplied to the head 100.

The head driving circuit 101 drives a channel group 102 of the head 100 based on the printing data. As shown in FIG. 6, the head driving circuit 101 includes a charging and discharging circuit 300, a waveform generation circuit 400, and a power circuit.

In the embodiment, the head driving circuit 101 is described as a head driving circuit including the power circuit and the waveform generation circuit 400, but there is no limitation. Even when the power circuit and the waveform generation circuit 400 are in a position physically separated from the ink jet head 100, the power circuit and the waveform generation circuit 400 are defined as a circuit group configuring the ink jet head 100.

In the charging and discharging circuit 300, a first voltage source 301 which outputs a direct voltage E/2 [V] which is half of a driving voltage E [V] which is a charging target and a second voltage source 302 which outputs the same direct voltage E/2 [V] are connected to a power circuit which is connected in series. The power circuit connects a negative electrode of the first voltage source 301 and a positive electrode of the second voltage source 302 and a connected point is grounded to a ground of zero [V]. Accordingly, a power line L1 connected to the positive electrode of the first voltage source 301 is set as a positive power line of +E/2 [V]. A power line L2 connected to the negative electrode of the second voltage source 302 is set as a negative power line of −E/2 [V]. A power line L3 connected to the connected point of the negative electrode of the first voltage source 301 and the positive electrode of the second voltage source 302 is set as a ground line of zero [V]. The charging and discharging circuit 300 is also connected to a reference power VBG of +24 [V] through the power line L4.

In the charging and discharging circuit 300, a plurality of switch series circuits are connected between the positive power line L1 and the negative power line L2. Specifically, in the charging and discharging circuit 300, a switch series circuit between a switch element S12 and a switch element S11, a switch series circuit between a switch element S22 and a switch element S21, . . . , and a switch series circuit between a switch element Sn2 and a switch element Sn1 are connected between the positive power line L1 and the negative power line L2.

In the charging and discharging circuit 300, a switch element S13, a switch element S23, . . . , and a switch element Sn3 are connected between the switch element connection point of each switch series circuit and the ground line L3. In the charging and discharging circuit 300, capacitive-type actuators Z1, Z2 (not shown), . . . , Zm (m=n−1) which are the piezoelectric elements, are connected between the neighboring switch element connection points of the switch series circuits.

Among the switch elements of the switch series circuits, the switch elements S12, S22, . . . , and Sn2 connected to the positive power line L1 are P-type channel MOS transistors. Among the switch elements of the switch series circuits, the switch elements S11, S21, . . . , and Sn1 connected to the negative power line L2 are N-type channel MOS transistors. Accordingly, in the charging and discharging circuit 300, a number of series circuits of a source and a drain of the P-type channel MOS transistor and a drain and a source of the N-type channel MOS transistor are connected between the positive power line L1 and the negative power line L2.

The switch elements S13, S23, . . . , and Sn3 are N-type channel MOS transistors. Accordingly, in the charging and discharging circuit 300, a source and a drain of the N-type channel MOS transistor are connected between the switch element connection points of each switch series circuit and the ground line L3.

Back gates of the P-type channel MOS transistors (switch elements S12, S22, . . . , and Sn2) are connected to the reference power line L4 of +24 [V]. Back gates of the N-type channel MOS transistors (switch elements S11, S21, . . . , and Sn1 and switch elements S13, S23, . . . , and Sn3) are connected to the negative power line L2 of −E/2 [V]. All of the gates of the P-type channel MOS transistors (switch elements S12, S22, . . . , and Sn2) and the gates of the N-type channel MOS transistors (switch elements S11, S21, . . . , Sn1 and switch elements S13, S23, . . . , and Sn3) are connected to the waveform generation circuit 400.

The waveform generation circuit 400 generates a driving waveform for controlling switching on and off of the switch elements S12, S22, . . . , Sn2, S13, S23, . . . , Sn3, S11, S21, . . . , and Sn1. The switch elements S12, S22, . . . , Sn2, S13, S23, . . . , Sn3, S11, S21, . . . , and Sn1 are switched on and off by the driving waveform output from the waveform generation circuit 400. By switching the switch elements on or off, the actuators Z1, Z2, . . . , and Zn are charged or discharged.

Herein, the switch elements S11, the switch elements S12, and the switch elements S13, and the switch elements S21, the switch elements S22, and the switch elements S23 connected to each other with the actuator Z1 interposed therebetween, form an electric connection path for charging and discharging with respect to the actuator Z1. Although not shown, the switch elements S21, the switch elements S22, and the switch elements S23, and the switch elements S31, the switch elements S32, and the switch elements S33 connected to each other with the actuator Z2 interposed therebetween, form an electric connection path for charging and discharging with respect to the actuator Z2. The same applies to other actuators Z3 to Zm. Therefore, for convenience of description, hereinafter, the embodiment will be described by focusing on the actuator Z1, and the six switch elements S11, S12, S13, S21, S22, and S23 for forming the electric connection path to the actuator Z1.

FIG. 6B is a modification example of the head driving circuit 101 shown in FIG. 6A. As shown in FIG. 6B, the switch elements S13, S23, . . . , and Sn3 which are N-type channel MOS transistors can be replaced with switch elements S13', S23', . . . , and Sn3' which are P-type channel MOS transistors. The N-type channel MOS transistors are turned on at a gate voltage High and the P-type channel MOS transistors are turned on at a gate voltage Low. Accordingly, as shown in FIG. 6B, when using the P-type channel MOS transistors for the switch elements S13', S23', . . . , and Sn3', a logic level applied to the gates of the switch elements S13', S23', . . . , and Sn3' may be reversed to a logic level applied to the gates of the switch elements S13, S23, . . . , and Sn3 which are N-type channel MOS transistors of FIG. 6A.

In addition, although not shown, in order to decrease impedance of the switch circuit, a parallel circuit of the N-type channel MOS transistors and the P-type channel MOS transistors is used as the switch elements S13, S23, . . . , and Sn3 of FIG. 6A. In this case, the logic levels reversed to each other are applied to the N-type channel MOS transistors and the P-type channel MOS transistors.

Figure 7:
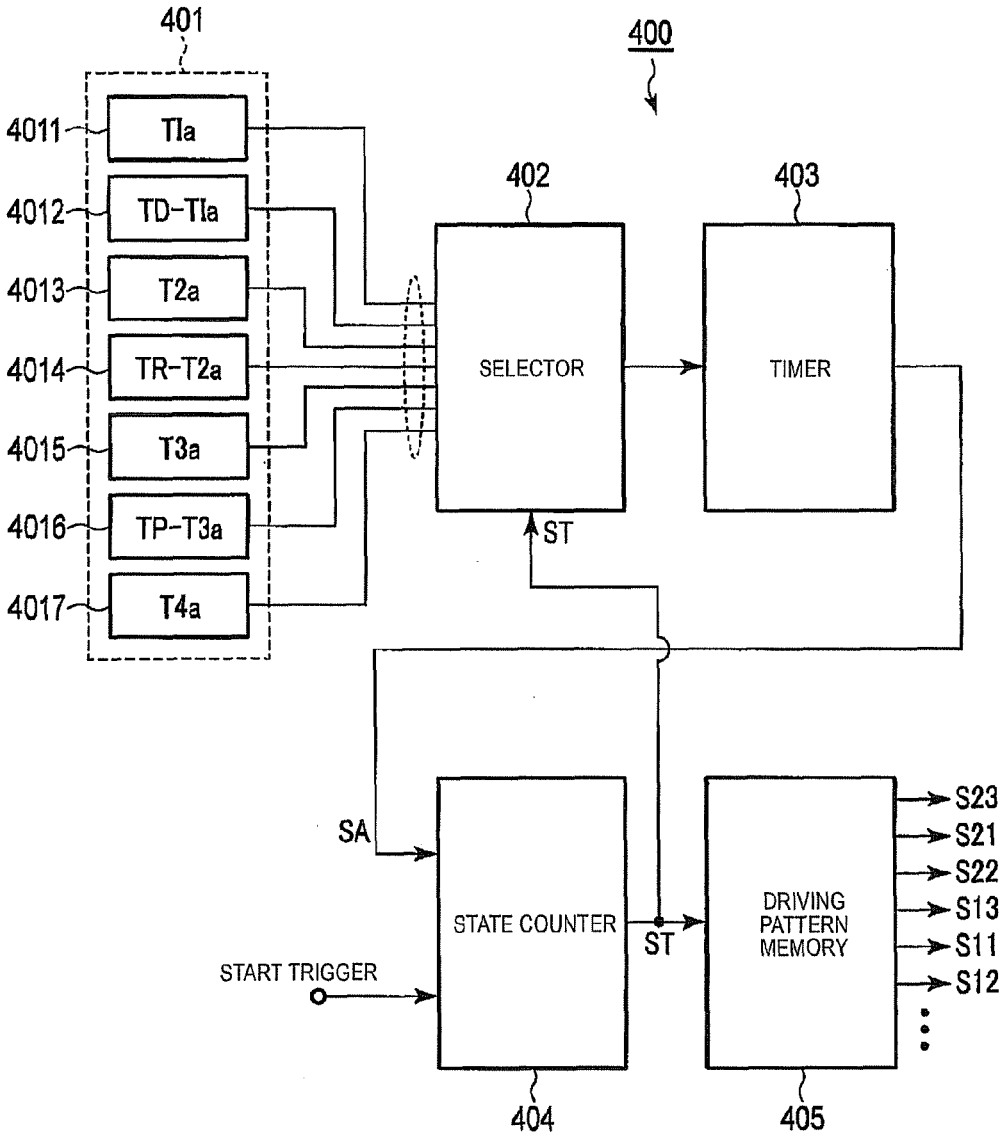
FIG. 7 is a block diagram showing a waveform generation circuit of a first embodiment.

FIG. 7 is a block diagram showing a configuration of the waveform generation circuit 400 of the first embodiment. The waveform generation circuit 400 includes a time setting register 401, a selector 402, a timer 403, a state counter 404, and a driving pattern memory 405.

The time setting register 401 includes a first setting register 4011, a second setting register 4012, a third setting register 4013, a fourth setting register 4014, a fifth setting register 4015, a sixth setting register 4016, and a seventh setting register 4017. A time T1*a* is set in the first setting register 4011. A time (TD−T1*a*) is set in the second setting register 4012. A time T2*a* is set in the third setting register 4013. A time (TR−T2*a*) is set in the fourth setting register 4014. A time T3*a* is set in the fifth setting register 4015. A time (TP−T3*a*) is set in the sixth setting register 4016. A time T4*a* is set in the seventh setting register 4017. The time T1*a*, the time (TD−T1*a*), the time T2*a*, the time (TR−T2*a*), the time T3*a*, the time (TP−T3*a*), and the time T4*a* will be described later.

A selector 402 selects the time T1*a*, the time (TD−T1*a*), the time T2*a*, the time (TR−T2*a*), the time T3*a*, the time (TP−T3*a*), and the time T4*a* respectively set in the first to seventh setting registers 4011 to 4017, in order, according to state data ST output from a state counter 404. The selector 402 sets the selected time to a timer 403.

The timer 403 measures the time set by the selector 402. When the measurement of the time is completed, the timer 403 outputs a state update signal SA to the state counter 404.

The state counter 404 is an octal counter and the state data ST is reset to "0" in an initial state. In this state, when a trigger signal for waveform output start is input from the printer 200, the state counter 404 counts up the state data ST as "1". After that, at each time when the state update signal SA is input from the timer 403, the state counter 404 counts up the state data ST by "1". When the state data ST is counted to an upper limit value ("7" in the octal counter), the state counter 404 resets the state data ST as "0" by the input of the state update signal SA after that. The state counter 404 outputs the state data items ST0 to ST7 to the selector 402 and the driving pattern memory 405.

The driving pattern memory 405 stores driving pattern data by associating the driving pattern data with the state data items ST0 to ST7. The driving pattern data is data for controlling on and off of the six switch elements S11, S12, S13, S21, S22, and S23 which form the electric connection path to the actuator Z1. At each time when the state data items ST0 to ST7 are input from the state counter 404, the driving pattern memory 405 generates the driving waveform for controlling the switching on and off of the switch elements S11, S12, S13, S21, S22, and S23, according to the driving pattern data corresponding to the state data items ST0 to ST7.

Figure 8:
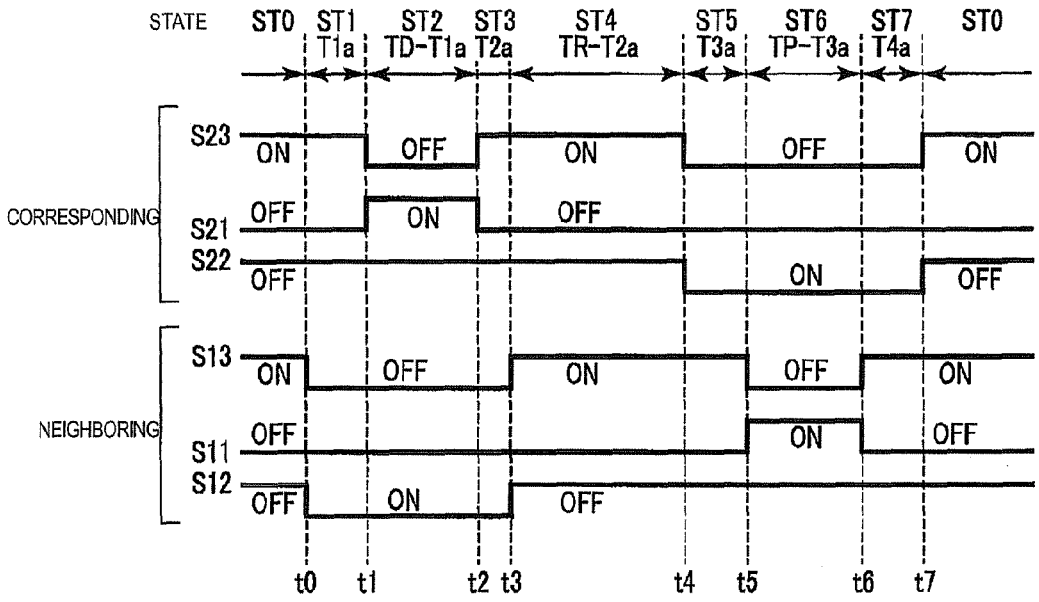
FIG. 8 is a diagram showing a correspondence relationship between state data and driving pattern data.

FIG. 8 is a diagram showing a correspondence relationship between the state data items ST0 to ST7 and the driving pattern data items. In the initial state of the state data ST0, the switch element S23 and the switch element S13 are turned on and the switch element S21, the switch element S22, the switch element S11, and the switch element S12 are turned off.

Figure 11:
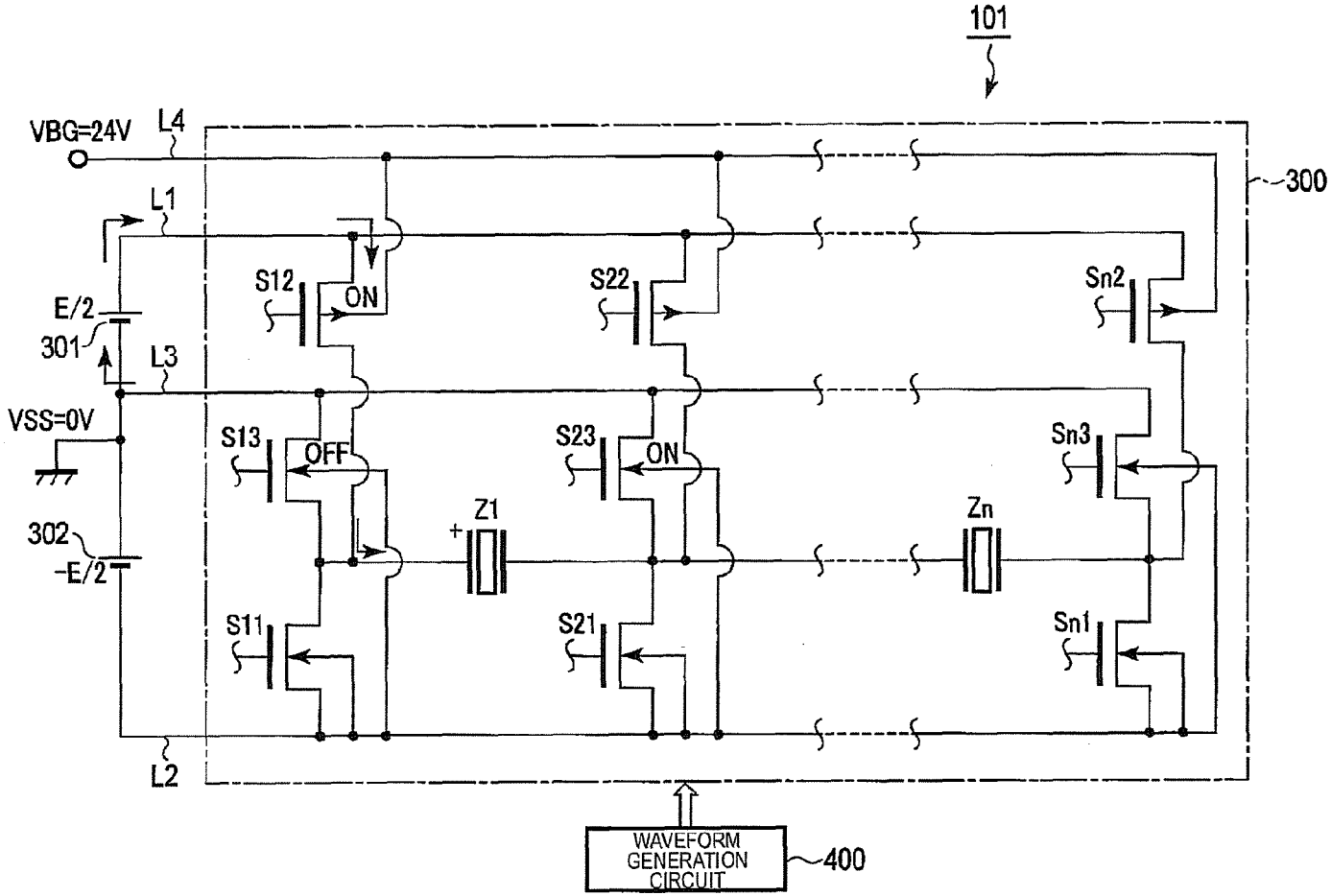
FIG. 11 is a diagram showing a charging path of a head driving circuit.

In this state, when a trigger signal for waveform output start is input to the state counter 404 and the state data is updated to ST1 from ST0 (time point t0), the switch element S13 is turned off and then the switch element S12 is turned on, due to the driving waveform of the driving pattern data corresponding to the state data ST1 output from the driving pattern memory 405. At that time, as shown in FIG. 11, a closed circuit of the first voltage source 301→the switch element S12→the actuator Z1→switch element S23→the first voltage source 301 is formed. As a result, the actuator Z1 is electrically connected and charged in a forward direction with the voltage E/2 [V].

As described above, in a first half stage of the charging, the half charge is charged to the actuator Z1 with the voltage E/2 [V] which is half of the driving voltage E [V] which is the charging target, using the first positive polarity voltage source 301. By charging the half charge to the actuator Z1 with the voltage E/2 [V], the charging and discharging circuit 300 can reduce a loss at the time of charging.

When the state data is updated to ST1 from ST0, the selector 402 selects the first setting register 4011. As a result, the timer 403 measures the time T1*a*. When the time T1*a* is measured and the timer 403 times out, the state data is updated to ST2 from ST1.

Figure 12:
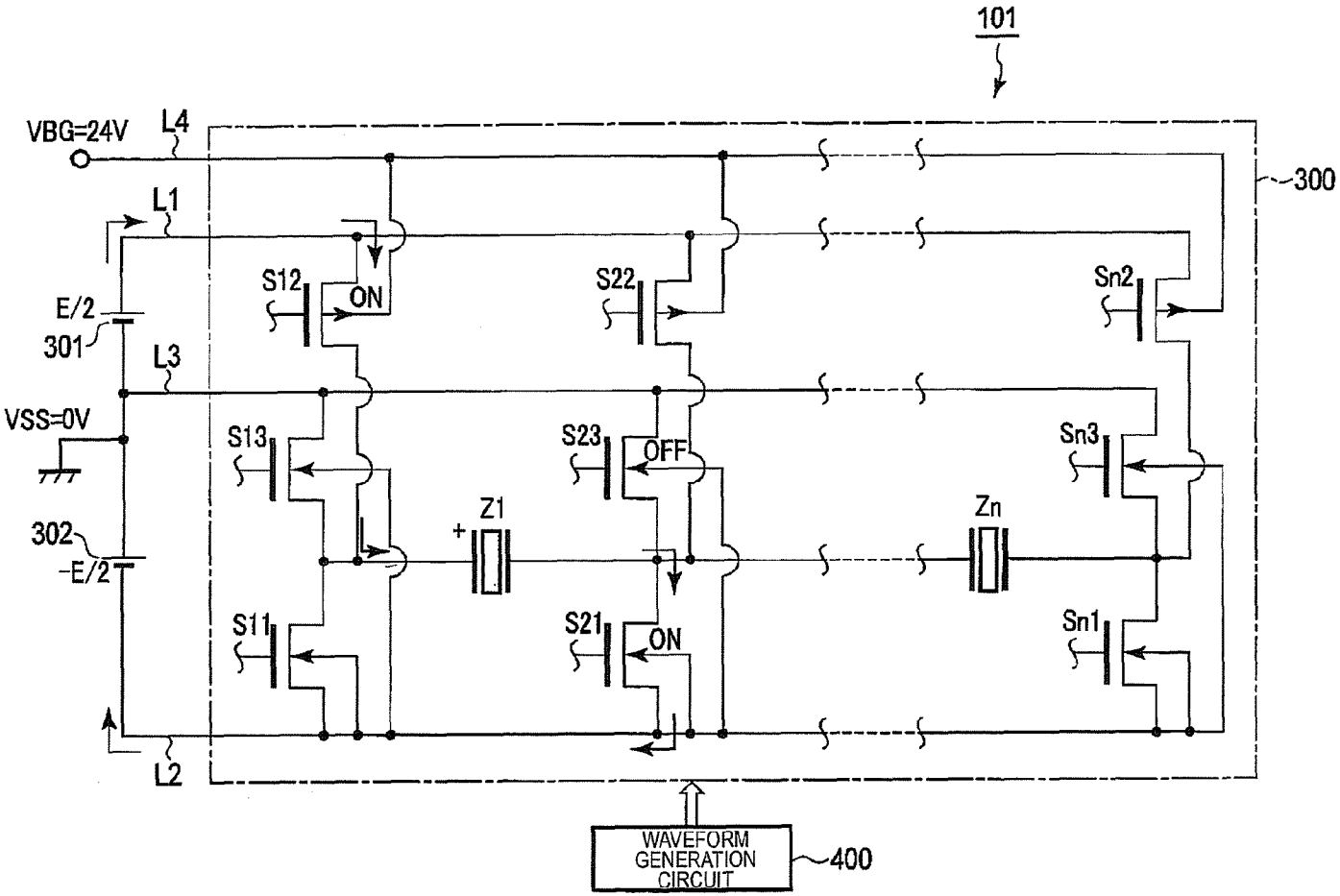
FIG. 12 is a diagram showing an additional charging path after FIG. 11 charging of the head driving circuit.

When the state data is updated to ST2 from ST1 (time point t1), the switch element S23 is turned off and then the switch element S21 is turned on, due to the driving waveform of the driving pattern data corresponding to the state data ST2. At that time, as shown in FIG. 12, a closed circuit of the first voltage source 301→the switch element S12→the actuator Z1→switch element S21→the second voltage source 302→the first voltage source 301 is formed. As a result, the actuator Z1 is electrically connected and charged in a forward direction with the voltage E [V].

As described above, in a second half stage of the charging, the charge is charged to the actuator Z1 with the driving voltage E [V] which is the charging target, using the first positive polarity voltage source 301 and the second negative polarity voltage source 302. By charging the charge to the actuator Z1 with the driving voltage E [V], the actuator Z1 is completely charged.

When the state data is updated to ST2 from ST1, the selector 402 selects the second setting register 4012. As a result, the timer 403 measures the time (TD−T1*a*). When the time (TD−T1*a*) is measured and the timer 403 times out, the state data is updated to ST3 from ST2.

Figure 13:
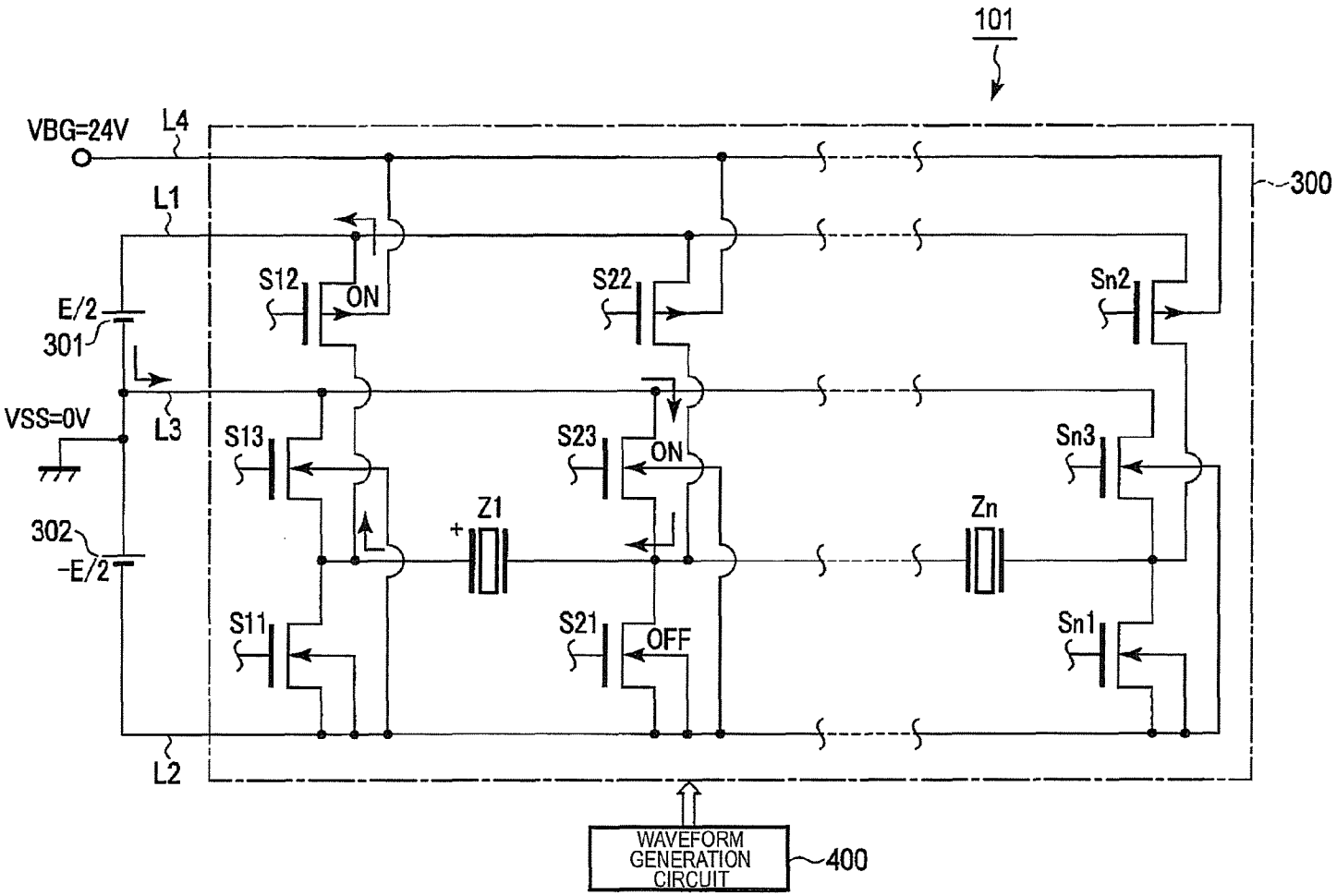
FIG. 13 is a diagram showing a discharging path after FIG. 12 charging of the head driving circuit.

When state data is updated to ST3 from ST2 (time point t2), the switch element S21 is turned off and then the switch element S23 is turned on, due to the driving waveform of the driving pattern data corresponding to the state data ST3. At that time, as shown in FIG. 13, a closed circuit of the actuator Z1→the switch element S12→the first voltage source 301→switch element S23→the actuator Z1 is formed. As a result, the actuator Z1 is discharged.

As described above, in a first half stage of the discharging, the charge is returned to the first positive polarity voltage source 301 from the actuator Z1, and the actuator Z1 is discharged while charging the voltage source 301. By discharging the actuator Z1 while charging the voltage source 301, the charging and discharging circuit 300 can also reduce a loss at the time of discharging.

When the state data is updated to ST3 from ST2, the selector 402 selects the third setting register 4013. As a result, the timer 403 measures the time T2*a*. When the time T2*a* is measured and the timer 403 times out, the state data is updated to ST4 from ST3.

Figure 14:
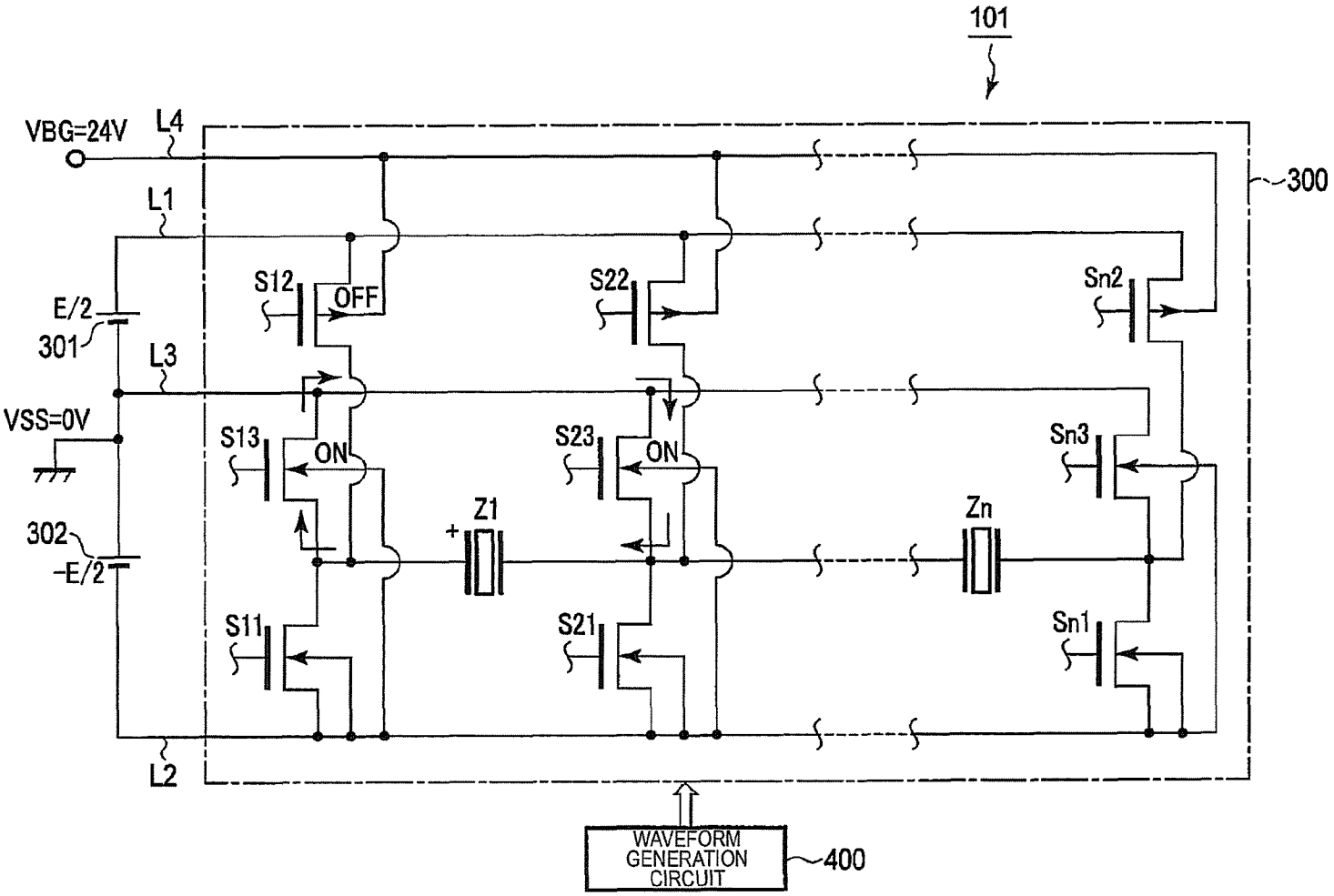
FIG. 14 is a flow diagram showing a farther discharging path after FIG. 13 discharging of the head driving circuit.

When the state data is updated to ST4 from ST3 (time point t3), the switch element S12 is turned off and then the switch element S13 is turned on, due to the driving waveform of the driving pattern data corresponding to the state data ST4. At that time, as shown in FIG. 14, a closed circuit of the actuator Z1→the switch element S13→the switch element S23→the actuator Z1 is formed. As a result, discharging of the actuator Z1 is continued.

As described above, in a second half stage of the discharging, the actuator Z1 is completely discharged by looping between the terminals of the actuator Z1.

By performing the charging and discharging operations described above, the head 100 replenishes ink by expanding the capacitance of the pressure chamber and returns the volume of the pressure chamber to the original state. By performing this operation, pressure fluctuation occurs in the pressure chamber and the ink droplets are ejected from the nozzles. The ejecting timing is at the time of the discharging operation.

When the state data is updated to ST4 from ST3, the selector 402 selects the fourth setting register 4014. As a result, the timer 403 measures the time (TR−T2*a*). When the time (TR−T2*a*) is measured and the timer 403 times out, the state data is updated to ST5 from ST4.

When the state data is updated to ST5 from ST4 (time point t4), the switch element S23 is turned off and then the switch element S22 is turned on, due to the driving waveform of the driving pattern data corresponding to the state data ST5. At that time, although not shown, a closed circuit of the first voltage source 301→the switch element S22→the actuator Z1→switch element S13→the first voltage source 301 is formed. As a result, the actuator Z1 is electrically connected and charged in a reverse direction with the voltage E/2 [V].

As described above, in a first half stage of the reverse charging, the half charge is charged to the actuator Z1 in the reverse direction with the voltage E/2 [V] which is half of the driving voltage E [V] which is the charging target, using the first positive polarity voltage source 301. By charging the half charge to the actuator Z1 in the reverse direction with the voltage E/2 [V], the charging and discharging circuit 300 can reduce a loss at the time of reverse charging.

When the state data is updated to ST5 from ST4, the selector 402 selects the fifth setting register 4015. As a result, the timer 403 measures the time T3*a*. When the time T3*a* is measured and the timer 403 times out, the state data is updated to ST6 from ST5.

When the state data is updated to ST6 from ST5 (time point t5), the switch element S13 is turned off and then the switch element S11 is turned on, due to the driving waveform of the driving pattern data corresponding to the state data ST6. At that time, although not shown, a closed circuit of the first voltage source 301→the switch element S22→the actuator Z1→switch element S11→the second voltage source 302→the first voltage source 301 is formed. As a result, the actuator Z1 is electrically connected and charged in a reverse direction with the voltage E [V].

As described above, in a second half stage of the charging, the charge is charged to the actuator Z1 in the reverse direction with the driving voltage E [V] which is the charging target, using the first positive polarity voltage source 301 and the second negative polarity voltage source 302. By charging the charge to the actuator Z1 in the reverse direction with the driving voltage E [V], the actuator Z1 is completely charged in the reverse direction.

When the state data is updated to ST6 from ST5, the selector 402 selects the sixth setting register 4016. As a result, the timer 403 measures the time (TP−T3*a*). When the time (TP−T3*a*) is measured and the timer 403 times out, the state data is updated to ST7 from ST6.

When state data is updated to ST7 from ST6 (time point t6), the switch element S11 is turned off and then the switch element S13 is turned on, due to the driving waveform of the driving pattern data corresponding to the state data ST7. At that time, although not shown, a closed circuit of the actuator Z1→the switch element S22→the first voltage source 301→switch element S13→the actuator Z1 is formed. As a result, the actuator Z1 is discharged.

As described above, in a first half stage of the discharging, the charge is returned to the first positive polarity voltage source 301 from the actuator Z1, and the actuator Z1 is discharged while charging the voltage source 301. By discharging the actuator Z1 while charging the voltage source 301, the charging and discharging circuit 300 can also reduce a loss at the time of discharging.

When the state data is updated to ST7 from ST6, the selector 402 selects the seventh setting register 4017. As a result, the timer 403 measures the time T4*a*. When the time T4*a* is measured and the timer 403 times out, the state data is returned to ST0 from ST7.

When the state data is returned to ST0 from ST7 (time point t7), the switch element S22 is turned off and then the switch element S23 is turned on, due to the driving waveform of the driving pattern data corresponding to the state data ST0. At that time, a closed circuit of the actuator Z1→the switch element S23→the switch element S13→the actuator Z1 is formed. As a result, discharging of the actuator Z1 is continued.

As described above, in a second half stage of the discharging, the actuator Z1 is completely discharged by looping between the terminals of the actuator Z1.

By performing the charging and discharging operations described above, the head 100 contracts the volume of the pressure chamber and returns the volume to the original state. By performing this operation, residual fluctuation of the pressure chamber is cancelled.

Then, at each time a trigger signal for waveform output start is input to the state counter 404, the waveform generation circuit 400 repeatedly executes the same operations.

Figure 9:
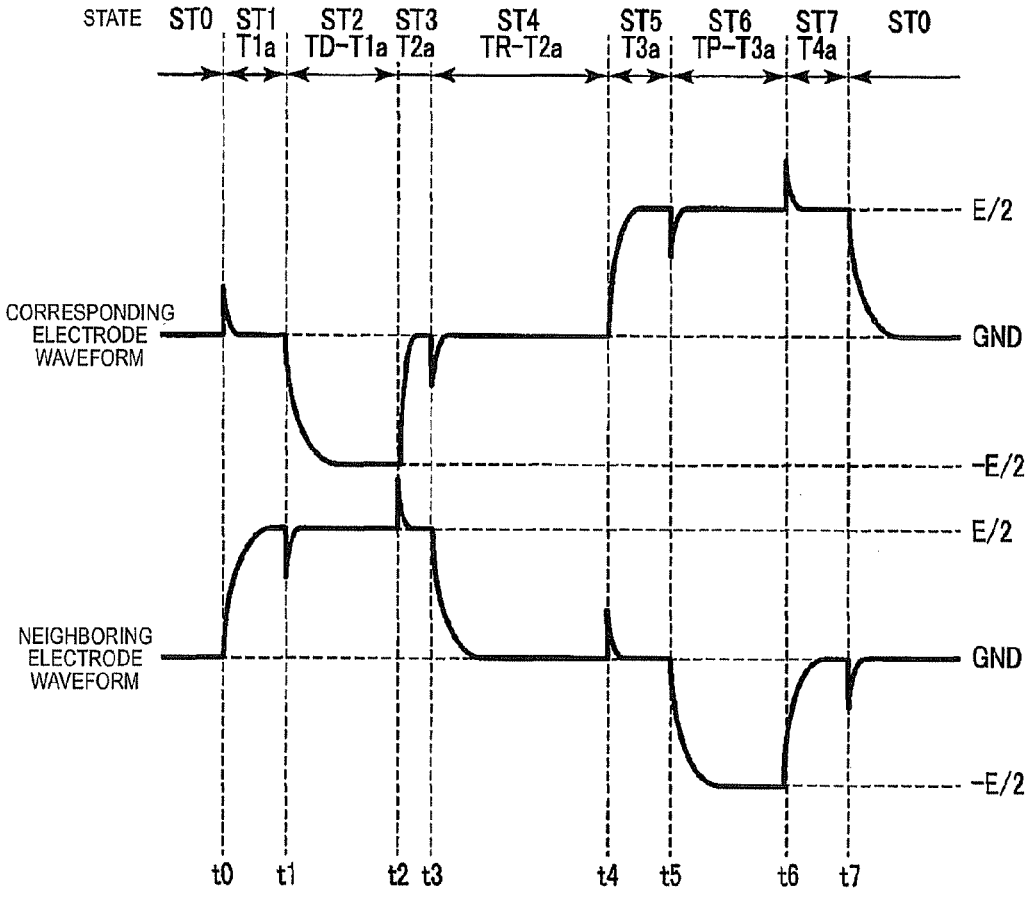
FIG. 9 is a diagram of a voltage waveform applied to each electrode of a certain channel and a neighboring channel.
Figure 10:
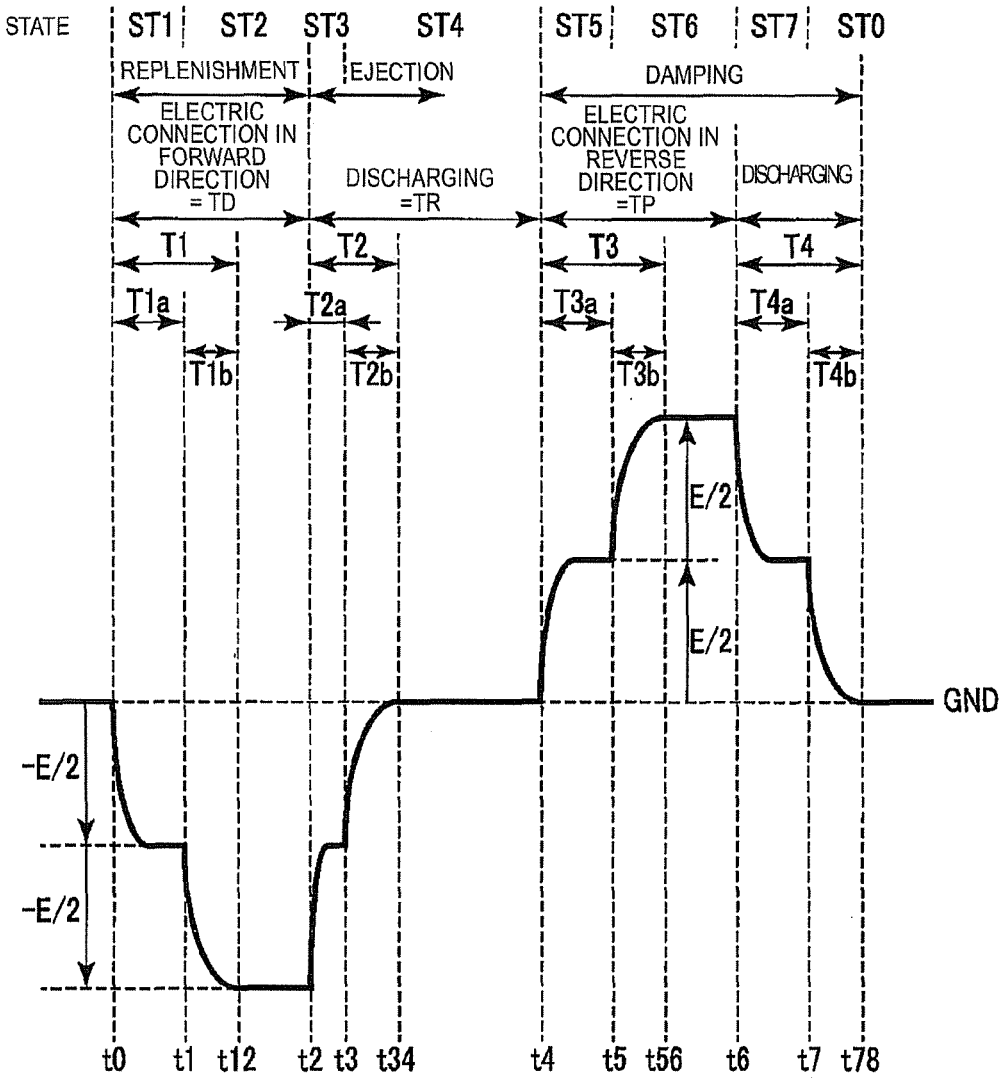
FIG. 10 is a diagram of a voltage waveform applied to an actuator.

FIG. 9 shows a waveform applied to the electrode of the corresponding channel (corresponding electrode waveform) and a waveform applied to the electrode of neighboring channels (neighboring electrode waveform) by using the driving pattern data described using FIG. 8. The corresponding channel is a channel interposed between the actuator Z1 and the actuator Z2 which is adjacent to the actuator Z1. The neighboring channels are neighboring channels with the corresponding channel interposed therebetween. FIG. 10 shows a waveform of the voltage applied to the actuator Z1 by using the two waveforms (corresponding electrode waveform and neighboring electrode waveform) shown in FIG. 9.

When the trigger signal for waveform output start is input to the state counter 404 and the state data is updated to ST1 from ST0 (time point t0), the voltage E/2 [V] is applied to the electrode of the neighboring channels. At that time, the potential of the electrode of the corresponding channel remains as the ground potential GND. Accordingly, the voltage −E/2 [V] is applied to the actuator Z1 and the partition walls of the corresponding channel start to be deformed in a direction of expanding the volume of the pressure chamber.

When the time T1*a* set in the first setting register 4011 is elapsed and the state data is updated to ST2 (time point t1), the voltage −E/2 [V] is applied to the electrode of the corresponding channel. At that time, a state where the voltage of E/2 [V] is applied to the electrode of the neighboring channels is maintained. Accordingly, additional −E/2 [V] is further applied, hence total −E [V] is applied to the actuator Z1 and the partition walls of the corresponding channel are deformed in a direction of further expanding the capacitance of the pressure chamber. By performing this expansion, the ink is replenished in the pressure chambers.

The time T1*a* from the update of the state data to ST1 (time point t0) to the update of the state data to ST2 (time point t1) is referred to as a former charging time. The time T1*b* required from the update of the state data to ST2 (time point t1) to the time when the voltage applied to the actuator Z1 reaches −E [V](time point t12) is referred to as a latter charging time. The total time T1 of the former charging time T1*a* and the latter charging time T1*b* is the charging time of the actuator Z1 to the electrostatic capacitance.

The time from the update of the state data to ST1 (time point t0) to the update of the state data to ST3 (time point t2) is represented as TD. The time obtained by subtracting the total time T1 from the time TD is a time for which the fully-charged actuator Z1 by the electric connection in a forward direction is maintained.

When the time (TD−T1*a*) set in the second setting register 4012 is elapsed and the state data is updated to ST3 (time point t2), the potential of the electrode of the corresponding channel is returned to the ground potential GND. Accordingly, the voltage applied to the actuator Z1 increases to −E/2 [V]. As a result, the partition walls of the corresponding channel rapidly start to be restored to the state before the expansion deformation.

When the time T2*a* set in the third setting register 4013 is elapsed and the state data is updated to ST4 (time point t3), the potential of the electrode of the neighboring channels is returned to the ground potential GND. Accordingly, the voltage applied to the actuator Z1 increases to 0[V]. As a result, the partition walls of the corresponding channel are restored to a state in which no deformation operation is received. The inkjet droplets are ejected from the nozzles of the corresponding channel by the pressure change in the pressure chamber accompanying modulation of the partition walls from the expansion to the restoration.

The time T2*a* from the update of the state data to ST3 (time point t2) to the update of the state data to ST4 (time point t3) is referred to as a former discharging time. The time T2*b* required from the update of the state data to ST4 (time point t3) to the time when the voltage of the actuator Z1 is returned to 0 [V](time point t34) is referred to as a latter discharging time. The total time T2 of the former discharging time T2*a* and the latter discharging time T2*b* is the discharging time of the actuator Z1.

The time from the update of the state data to ST3 (time point t2) to the update of the state data to ST5 (time point t4) is represented as TR. The time obtained by subtracting the total time T2 from the time TR is a time for which the discharged actuator Z1 is maintained.

When the time (TR−T2*a*) set in the fourth setting register 4014 is elapsed and the state data is updated to ST5 (time point t4), the voltage of E/2 [V] is applied to the electrode of the corresponding channel. At that time, the potential of the electrode of the neighboring channels remains as the ground potential GND. Accordingly, the voltage E/2 [V] is applied to the actuator Z1 and the partition walls of the corresponding channel start to be deformed in a direction of contracting the volume of the pressure chamber.

When the time T3*a* set in the fifth setting register 4015 is elapsed and the state data is updated to ST6 (time point t5), the voltage −E/2 [V] is applied to the electrode of the neighboring channels. At that time, a state where the voltage of E/2 [V] is applied to the electrode of the corresponding channel is maintained. Accordingly, the voltage of the actuator Z1 further increases by E/2 [V], hence total E [V] is applied to the actuator Z1, and the partition walls of the corresponding channel are deformed in a direction of further contracting the volume of the pressure chamber.

The time T3*a* from the update of the state data to ST5 (time point t4) to the update of the state data to ST6 (time point t5) is referred to as a former reverse charging time (former contracting time). The time T3*b* required from the update of the state data to ST6 (time point t5) to the time when the voltage applied to the actuator Z1 reaches E [V](time point t56) is referred to as a latter reverse charging time (latter contracting time). The total time T3 of the former reverse charging time T3*a* and the latter reverse charging time T3*b* is the charging time of the actuator Z1 in the reverse direction to the electrostatic capacitance.

The time from the update of the state data to ST5 (time point t4) to the update of the state data to ST7 (time point t6) is represented as TP. The time obtained by subtracting the total time T3 from the time TP is a time for which the fully-charged actuator Z1 by the electric connection in the reverse direction is maintained.

When the time (TP−T3*a*) set in the sixth setting register 4016 is elapsed and the state data is updated to ST7 (time point t6), the potential of the electrode of the neighboring channels is returned to the ground potential GND. Accordingly, the voltage applied to the actuator Z1 decreases to E/2

[V]. As a result, the partition walls of the corresponding channel start to be restored to the state before the contraction deformation.

When the time T4*a* set in the seventh setting register 4017 is elapsed and the state data is updated to ST0 (time point t7), the potential of the electrode of the corresponding channels is also returned to the ground potential GND. Accordingly, the voltage applied to the actuator Z1 decreases to 0 [V]. As a result, the partition walls of the corresponding channel are restored to a state in which no deformation operation is received. A damping operation is performed in order to cancel the pressure fluctuation occurring in the corresponding channel by the pressure change in the pressure chamber accompanying modulation of the partition walls from the contraction to the restoration.

The time T4*a* from the update of the state data to ST7 (time point t6) to the update of the state data to ST0 (time point t7) is referred to as a former reverse discharging time (former restoration time). The time T4*b* required from the update of the state data to ST0 (time point t7) to the time when the voltage of the actuator Z1 is returned to 0 [V](time point t78) is referred to as a latter reverse discharging time (latter restoration time). The total time T4 of the former reverse discharging time T4*a* and the latter reverse discharging time T4*b* is the charging time of the actuator Z1 in the reverse direction.

The former time, that is, the former charging time T1*a*, the former charging time T2*a*, the former reverse charging time T3*a*, and the former reverse charging time T4*a* are time for which the intermediate voltages having size of ±E/2 [V] are applied to the actuator, and this is time for which the actuator is connected to the first voltage source 301 through the switch element.

In the head 100 as an example, the total capacitance of the two actuators necessary for ejecting the ink droplets from one nozzle is 700 [pF] and the pressure propagation time of the pressure chamber is 3.32 [μs]. In such a head 100, the volume of the pressure chamber is expanded and the volume thereof is restored, by setting 1.66 [μs] which is half of the pressure propagation time as a reference time unit. The ink replenished in the pressure chamber is ejected from the nozzles due to the expansion and the restoration of the volume of the pressure chamber. After the ink is ejected, the head 100 performs damping by the contraction and the restoration of the volume of the pressure chamber. A pulse width for the damping is defined in accordance with damping characteristics of the head 100. In general, the pulse width is approximately from 1.5 μs to 2.0 μs.

Figure 15:
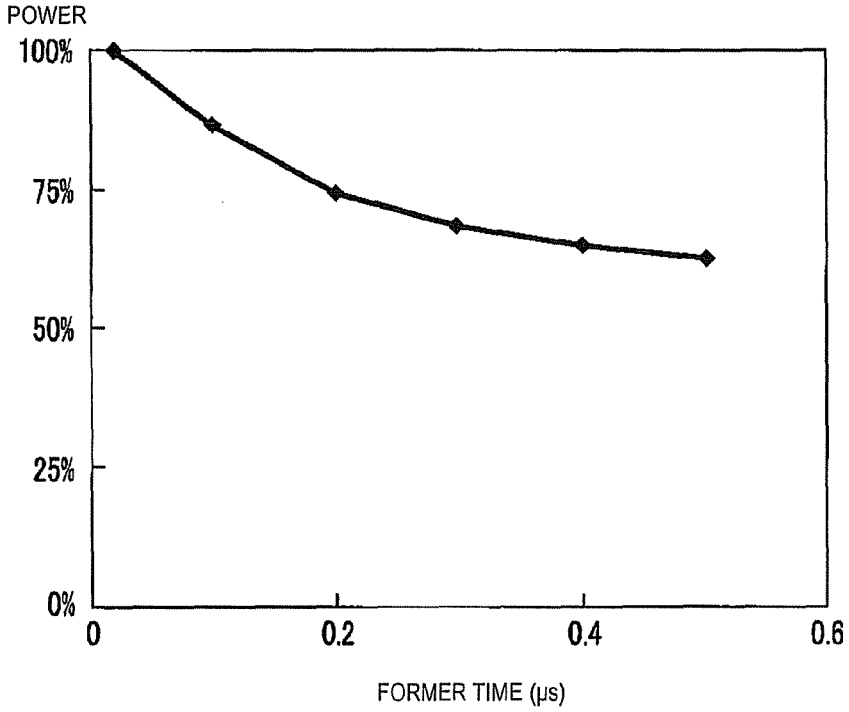
FIG. 15 is a diagram showing a correspondence relationship between time for applying an intermediate voltage and power consumption.

In such a head 100, measured driving power ratio for the former times T1*a*, T2*a*, T3*a*, and T4*a*, which is set to be the same as each other, is shown in a graph of FIG. 15. From this graph, it is found that, when the former times T1*a*, T2*a*, T3*a*, and T4*a* are set to be enough long, the driving power approaches 50% which is a theoretical value. Thus the power consumption can be reduced depending on the former time. On the other hand, when the former times T1*a*, T2*a*, T3*a*, and T4*a* are set to be relatively short, the reduction effect of the power consumption decreases correspondingly.

Though the influences on the power are the same for each former times T1*a*, T2*a*, T3*a*, and T4*a*, the influences on the ejection characteristics are different from each other in the former times T1*a*, T2*a*, T3*a*, and T4*a*. Particularly, the effect on the ejection is great in the former discharging time T2*a* relating to the ink ejection. Specifically, when the former discharging time T2*a* is set to be slightly long, the ejecting speed of the ink decreases.

On the other hand, the effect on the ink ejection is small in the former charging time T1*a* relating to the ink replenishment, compared to a case of the former discharging time T2*a*. There is no direct effect on efficiency of the ink ejection in the former reverse charging time T3*a* and the former reverse discharging time T4*a* relating to the damping. However, when the former reverse discharging time T4*a* is set to be long, a driving period for ejecting the ink droplets may increase and a driving frequency may decrease correspondingly. The former reverse charging time T3*a* relates to the damping. However, the damping should be finally adjusted with the time TR and TP, the reverse charging time T3*a* can be longer than the length of the other former charging time T1*a*, the discharging time T2*a*, and the former reverse discharging time T4*a* without any negative effect.

When considering the above-mentioned points, by setting the former charging time T1*a*, the former reverse charging time T3*a*, and the former reverse discharging time T4*a* to be relatively long and setting the former discharging time T2*a* relating to the ink ejection to be relatively short, it is possible to keep the ejecting speed of the ink while suppressing the power consumption and to obtain stable ejection efficiency. Such actions significantly occur by setting the former discharging time T2*a* to be half or shorter than the former charging time T1*a*, the former reverse charging time T3*a*, and the former reverse discharging time T4*a*. At that time, an effect of reduction of the power consumption is obtained by setting at least one of the former charging time T1*a*, the former reverse charging time T3*a*, and the former reverse discharging time T4*a* to be longer than the former discharging time T2*a*. When all of the former charging time T1*a*, the former reverse charging time T3*a*, and the former reverse discharging time T4*a* are set to be longer than the former discharging time T2*a*, the maximum effect of reduction of the power consumption is obtained.

Figure 16:
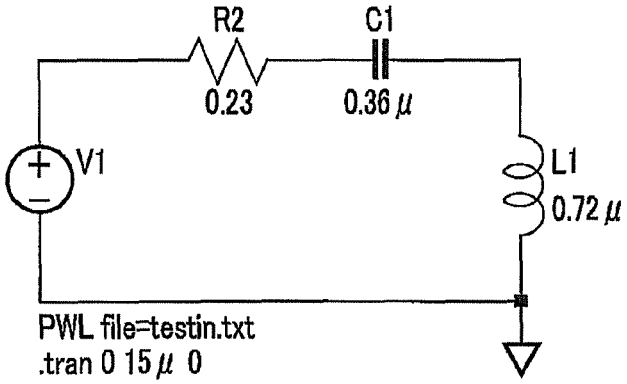
FIG. 16 is a diagram of an equivalent circuit for verification.

Hereinafter, verification is performed regarding the fact that it is effective to set the former charging time T1*a*, the former reverse charging time T3*a*, and the former reverse discharging time T4*a* to be relatively long and to set the former discharging time T2*a* to be relatively short. The verification is performed using an equivalent circuit model of FIG. 16. The equivalent circuit model is for simulation of ink pressure of the pressure chamber and an ink fluid velocity with respect to the driving waveform. In the equivalent circuit model, a voltage between both ends of a voltage source V1 represents the driving voltage, a voltage between both ends of an inductor L1 represents the pressure of the pressure chamber, and circuit current represents a fluid velocity of the ink.

Figure 17:
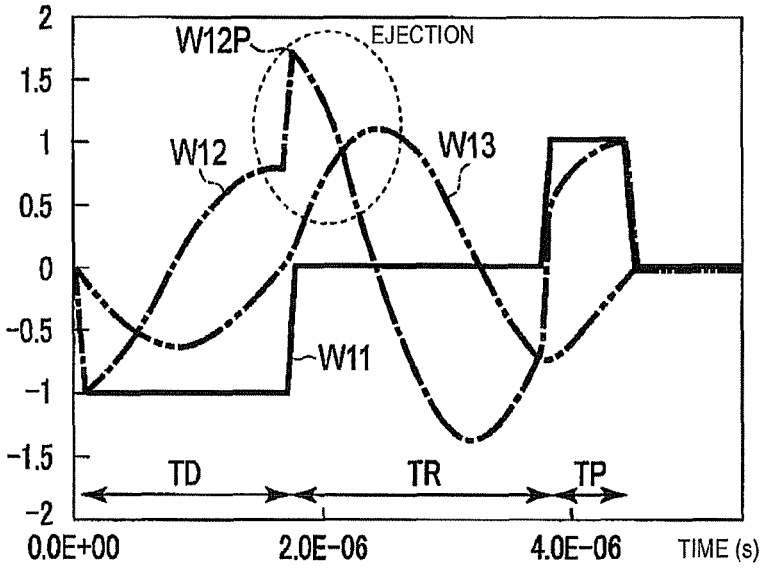
FIG. 17 is a diagram showing a simulation result of fluid velocity of the ink and pressure generated in a pressure chamber due to a driving waveform of the related art.

First, as shown in FIG. 17, the simulation of pressure W12 of the pressure chamber and a fluid velocity W13 of the ink is performed regarding a driving waveform W11 of the related art in which the charging time, the discharging time, the reverse charging time, and the reverse discharging time are not divided into the former and latter stages. In a case of this driving waveform W11, a maximum pressure W12P of the pressure chamber when ejecting the ink instantaneously forms one peak, and a sufficient ejecting speed is obtained. However, in a case of the waveform W11, there is a problem of great power consumption.

Figure 18:
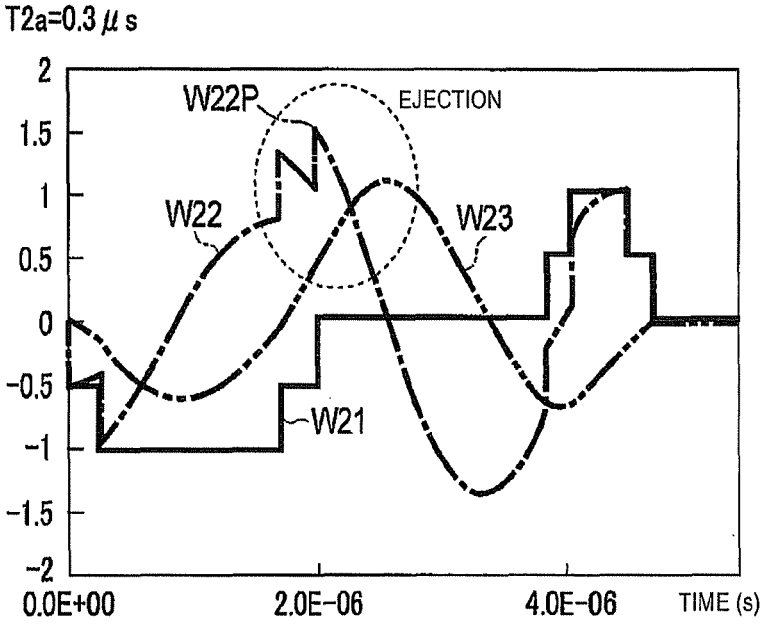
FIG. 18 is a diagram showing a simulation result of fluid velocity of the ink and pressure generated in the pressure chamber due to a driving waveform, when time for applying an intermediate voltage to an actuator charged to a driving voltage at a timing of ejecting the ink is set as 0.3 μs.
Figure 19:
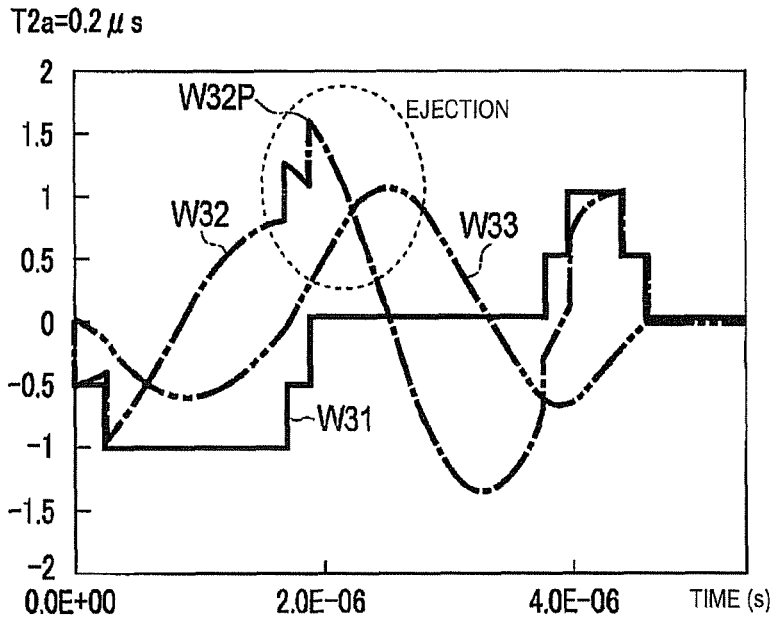
FIG. 19 is a diagram showing a simulation result of fluid velocity of the ink and pressure generated in the pressure chamber due to a driving waveform, when time for applying an intermediate voltage to an actuator charged to a driving voltage at a timing of ejecting the ink is set as 0.2 μs.
Figure 20:
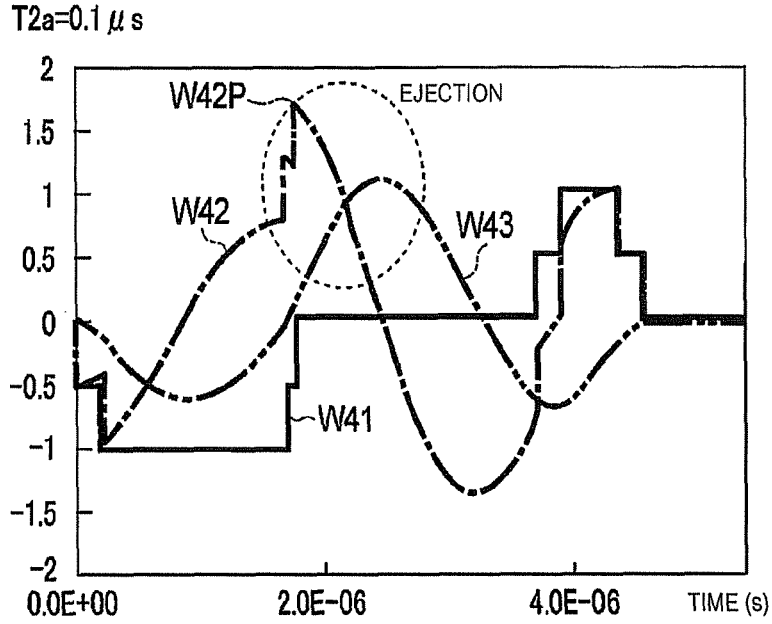
FIG. 20 is a diagram showing a simulation result of fluid velocity of the ink and pressure generated in the pressure chamber due to a driving waveform, when time for applying an intermediate voltage to an actuator charged to a driving voltage at a timing of ejecting the ink is set as 0.1 μs.

Next, as shown in FIGS. 18 to 20, pressure W22, W32, and W42 of the pressure chamber and fluid velocity W23, W33, and W43 of the ink are simulated, regarding the driving waveform W21, W31, and W41 including the former times T1*a*, T2*a*, T3*a*, and T4*a*.

In FIGS. 18 to 20, all of the former charging time T1*a*, the former reverse charging time T3*a*, and the former reverse discharging time T4*a* are commonly set as 0.2 μs. Meanwhile, regarding the former discharging time T2*a*, data of FIG. 18 is set as 0.3 μs, data of FIG. 19 is set as 0.2 μs, and data of FIG.

20 is set as 0.1 μs. A pulse width and a pulse position of the second half of each driving waveform which is for contracting and returning the pressure chamber for the damping, are adjusted under conditions so that the pressure fluctuation is optimally cancelled.

In a case of the driving waveforms W21, W31, and W41 including the former times T1*a*, T2*a*, T3*a*, and T4*a*, the peak of the maximum pressures W22P, W32P, and W42P of the pressure chamber when the ink is ejected, is divided into two. In addition, when the former discharging time T2*a* is set to be longer than the other former charging time T1*a*, the former reverse charging time T3*a*, and the former reverse discharging time T4*a* (see FIG. 18), the maximum pressure W22P greatly decreases compared to the maximum pressure W12P of FIG. 17. When the former discharging time T2*a* is set to be the same as the other former charging time T1*a*, the former reverse charging time T3*a*, and the former reverse discharging time T4*a* (see FIG. 19), the maximum pressure W32P decreases compared to the maximum pressure W12P of FIG. 17. Accordingly, the ejecting speed of the ink decreases in these cases.

However, when the former discharging time T2*a* is set as 0.1 μs (see FIG. 20), the maximum pressure W22P is substantially the same as that in a case of the deformation of the related art. Accordingly, the ejecting speed of the ink does not decrease. In addition, since the former charging time T1*a*, the former reverse charging time T3*a*, and the former reverse discharging time T4*a* are 0.2 μs, an effect of suppressing the power consumption is obtained, compared to the technology of the related art in which the charging time, the discharging time, the reverse charging time, and the reverse discharging time are not divided into the former and latter stages. This effect is significantly obtained by setting the former discharging time T2*a* to be half or shorter than at least one of the former charging time T1*a*, the former reverse charging time T3*a*, and the former reverse discharging time T4*a*. When all of the former charging time T1*a*, the former reverse charging time T3*a*, and the former reverse discharging time T4*a* are set to be longer than the former discharging time T2*a*, the maximum effect of reduction of power consumption is obtained.

Figure 21:
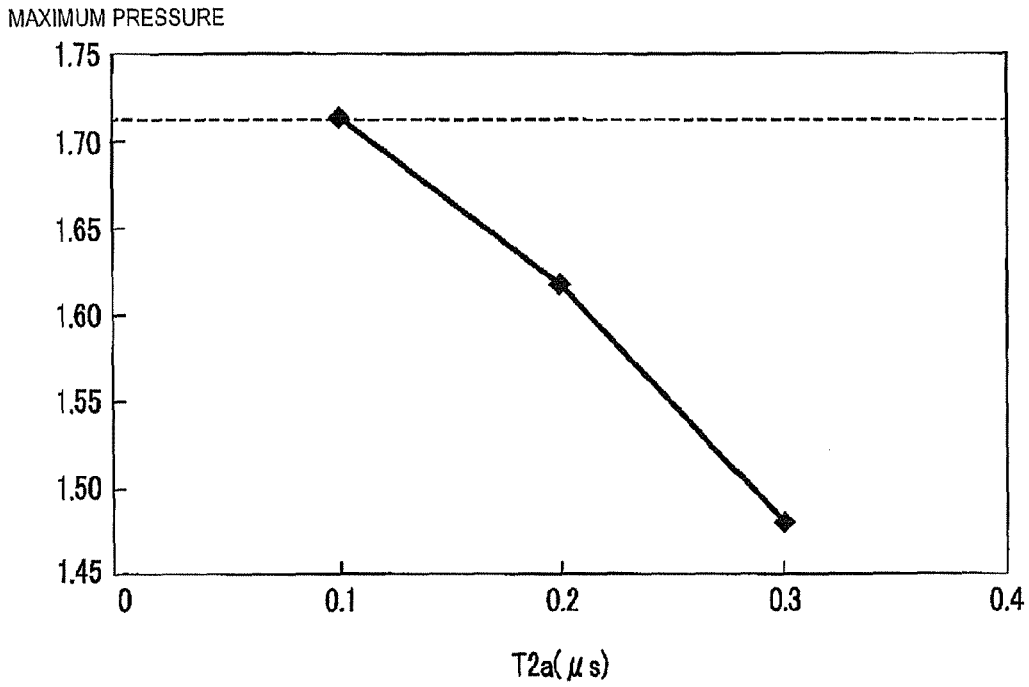
FIG. 21 is a diagram showing a correspondence relationship between time for applying an intermediate voltage to an actuator charged to a driving voltage at a timing of ejecting the ink and maximum pressure of the pressure chamber.

In addition, in FIG. 21, a horizontal axis indicates the former charging time T2*a* and a vertical axis indicates the maximum pressure of the pressure chamber when the ink is ejected, and FIG. 21 is a graph showing a correspondence relationship between the former charging time and the maximum pressure, in the simulation described above.

As described above, when charging the actuator, the waveform generation circuit 400 of the first embodiment outputs the driving waveform to the charging and discharging circuit 300 so as to firstly charge the actuator by applying the intermediate voltage E/2 [V] to the actuator and then charge the actuator so that the voltage thereof reaches the driving voltage E [V]. Then, when discharging the actuator, the waveform generation circuit 400 outputs the driving waveform to the charging and discharging circuit 300 so as to discharge the actuator by applying the intermediate voltage E/2 [V] to the actuator which is charged to the driving voltage E [V] and then discharge the actuator so that the voltage becomes zero. The time T2*a* for which the intermediate voltage E/2 [V] is applied to discharge the actuator which is charged to the driving voltage E [V] at the time of ejecting the ink from the nozzles, is set to be shorter than the times T1*a* and T3*a* for which the intermediate voltage E/2 [V] is applied to charge the actuator at other timings and the time T4*a* for which the intermediate voltage E/2 [V] is applied to discharge the actuator at other timing.

With the head 100 including the waveform generation circuit 400, an effect of reducing the power consumption while maintaining the sufficient ejecting speed of the ink is obtained.

The exemplary embodiment is not limited to the embodiment (first embodiment).

In the embodiment, the former discharging time T2*a* was set to be shorter than the former charging time T1*a*, the reverse charging time T3*a*, and the reverse charging time T4*a*. The former charging time T2*a* relates to the ejecting speed of the ink. When the former charging time T2*a* is set to be relatively short, the ejecting speed of the ink increases. In contrast, when the former charging time T2*a* is set to be relatively long, the ejecting speed of the ink decreases. In addition, an ejection volume of the ink also decreases.

That is, it is possible to provide an ink jet head which can adjustably set the ejection characteristics of the ink, by setting the former charging time T2*a* to be relatively short or long. Therefore, subsequently, embodiments (second to fourth embodiments) of the ink jet head which can adjustably set the ejection characteristics of the ink while suppressing the power consumption will be described with reference to the drawings.

The point of the second to fourth embodiments different from that of the first embodiment is the configuration of the waveform generation circuit 400. The other points are the same as those of the first embodiment, and therefore, the same reference numerals are used and the description thereof is omitted.

Second Embodiment

Figure 22:
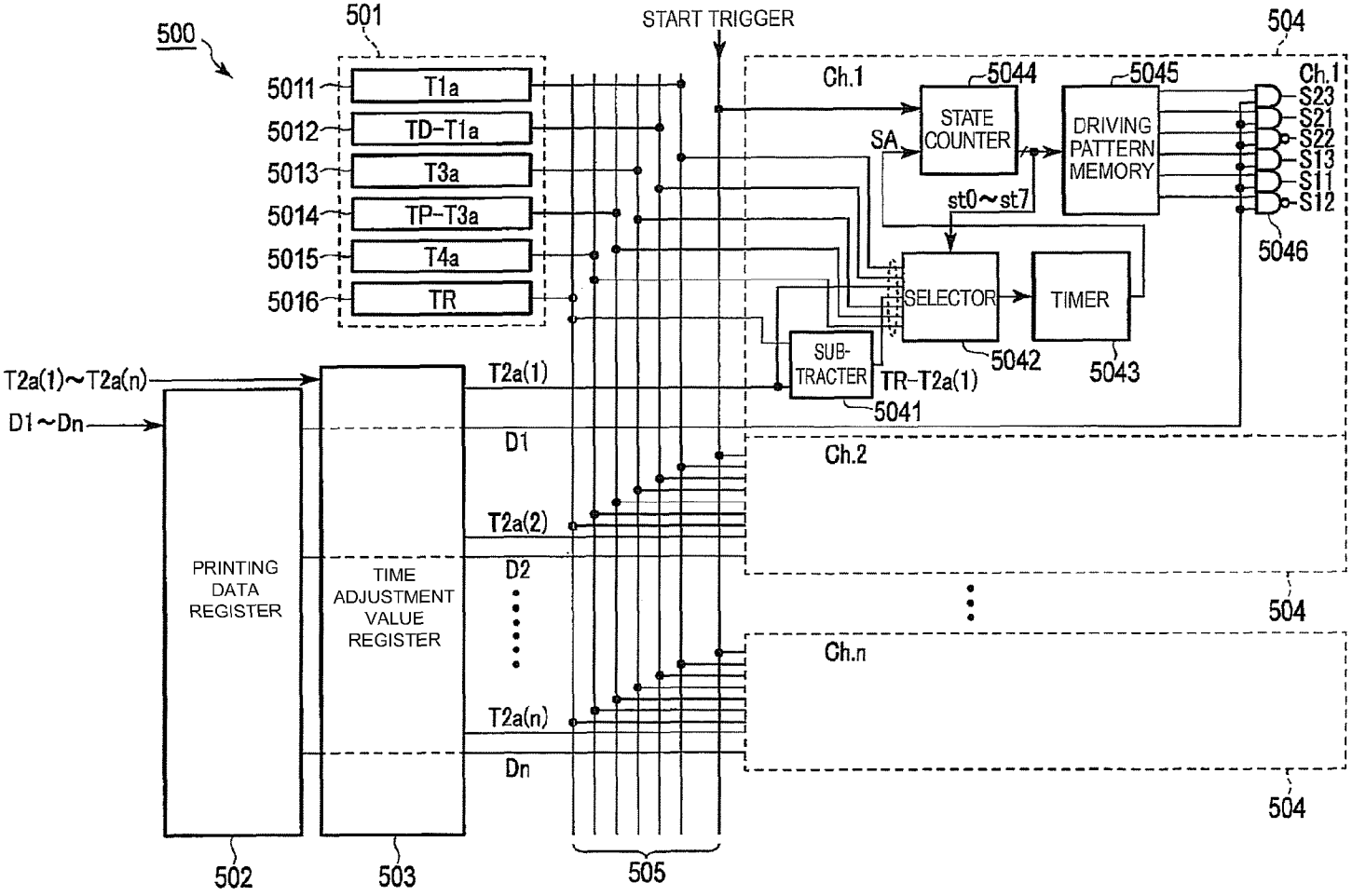
FIG. 22 is a block diagram showing a configuration of a waveform generation circuit of a second embodiment.

FIG. 22 is a block diagram showing a configuration of a waveform generation circuit 500 of the second embodiment. The waveform generation circuit 500 includes a time setting register 501, a printing data register 502, and a time adjustment value register 503 which are commonly used for channels Ch. 1, Ch. 2, . . . , and Ch. n, a circuit unit 504 for each of the channels Ch. 1, Ch. 2, . . . , and Ch. n, and signal lines 505. The signal lines 505 electrically connect the time setting register 501, the printing data register 502, and the time adjustment value register 503, and each circuit unit 504 to each other.

Each circuit unit 504 is a circuit group which generates the driving waveform with respect to the corresponding channel. The driving waveform is a waveform for controlling on and off of the six switch elements which form the electric connection path to the actuator included in the channel. Each circuit unit 504 has the same configuration. Accordingly, FIG. 22 only shows the specific configuration for the circuit unit 504 with respect to the channel Ch. 1. In addition, a case where the circuit unit 504 applies the driving waveform to the switch elements S11, S12, S13, S21, S22, and S23 will be described. The description regarding the circuit unit 504 with respect to the other channels Ch. 2, . . . , and Ch. n is overlapped, and therefore, the description thereof is omitted herein. In this embodiment, actuators are channel independent and not shared with neighboring channels.

The time setting register 501 includes an $11^{th}$ setting register 5011, a $12^{th}$ setting register 5012, a $13^{th}$ setting register 5013, a $14^{th}$ setting register 5014, a $15^{th}$ setting register 5015, and a $16^{th}$ setting register 5016. A time T1*a* is set in the $11^{th}$ setting register 5011. A time (TD−T1*a*) is set in the $12^{th}$ setting register 5012. A time T3*a* is set in the $13^{th}$ setting register 5013. A time (TP−T3*a*) is set in the $14^{th}$ setting register 5014. A time T4*a* is set in the $15^{th}$ setting register 5015. A time TR is set in the $16^{th}$ setting register 5016. The time T1*a*, the time (TD−T1*a*), the time T3*a*, the time (TP−T3*a*), the time T4*a*, and the time TR have the same meaning as the time having the same reference numerals described with reference to FIGS. 8 to 10 in the first embodiment. That is, in the time setting register 501 of the second embodiment, the third setting register 4013 in which the time T2*a* is set and the fourth setting register 4014 in which the time (TR−T2*a*) is set are removed, and the 16$^{th}$ setting register 5016 in which the time TR is set is added, compared to the time setting register 401 of the first embodiment.

The printing data register 502 receives input of printing data items D1 to Dn. The printing data items D1 to Dn correspond to the channels Ch. 1 to Ch. n one by one. The printing data register 502 stores the printing data items D1 to Dn transported from the image memory. The printing data register 502 outputs the printing data items D1 to Dn to the circuit unit 504 of the corresponding channels Ch. 1 to Ch. n by a first-in first-out (FIFO) method.

The time adjustment value register 503 receives input of time adjustment values T2*a*(1) to T2*a*(*n*). All of the time adjustment values T2*a*(1) to T2*a*(*n*) are times for which the intermediate voltage E/2 [V] is applied to the actuator at the time of first discharging. The time adjustment values T2*a*(1) to T2*a*(*n*) correspond to the channels Ch. 1 to Ch. n one by one. The time adjustment values T2*a*(1) to T2*a*(*n*) can be set as arbitrary values for each of the channels Ch. 1 to Ch. n. The time adjustment value register 503 stores the time adjustment values T2*a*(1) to T2*a*(*n*) set for each of the channels Ch. 1 to Ch. n. The time adjustment value register 503 outputs the time adjustment values T2*a*(1) to T2*a*(*n*) to the circuit unit 504 of the corresponding channels Ch. 1 to Ch. n.

The signal lines 505 connect the 11$^{th}$ to 16$^{th}$ setting registers 5011 to 5016 of the time setting register 501, the printing data register 502, and the time adjustment value register 503 to each circuit unit 504. In addition, the signal lines 505 apply a trigger signal for waveform output start to each circuit unit 504.

Each circuit unit 504 includes a subtracter 5041, a selector 5042, a timer 5043, a state counter 5044, a driving pattern memory 5045, and a gate circuit 5046. The gate circuit 5046 includes 2 input AND gate or NAND gate corresponding to the six switch elements S11, S12, S13, S21, S22, and S23. The gate circuit 5046 is set as the AND gate with respect to the switch elements S11 and S21 which are formed of the N-type channel MOS transistors and connected to the negative power line L2, and the switch elements S13 and S23 which are formed of the N-type channel MOS transistors and connected to the ground line L3. The gate circuit 5046 is set as the NAND gate with respect to the switch elements S12 and S22 which are formed of the P-type channel MOS transistors and connected to the positive power line L1.

The printing data D1 output from the printing data register 502 is applied to the input performed through one of the AND gate and the NAND gate. The driving waveform generated for each of the switch elements S11, S12, S13, S21, S22, and S23 from the driving pattern memory 5045 is applied to the other input performed through one of the AND gate and the NAND gate.

The subtracter 5041 subtracts the time T2*a*(1) corresponding to the channel Ch. 1 set in the time adjustment value register 503, from the time TR set in the 16$^{th}$ setting register 5016. The subtracter 5041 outputs the subtracted time (TR−T2*a*(1)) to the selector 5042.

The selector 5042 selects the time T1*a* and the time (TD−T1*a*) set in the 11$^{th}$ setting register 5011 and the 12$^{th}$ setting register 5012, the time T2*a*(1) set in the time adjustment value register 503, the time (TR−T2*a*(1)) output from the subtracter 5041, the time T3*a*, the time (TP−T3*a*), and the time T4*a* set in the 13$^{th}$ setting register 5013, the 14$^{th}$ setting register 5014, and the 15$^{th}$ setting register 5015, in order, according to state data items ST0 to ST7 output from a state counter 5044. Specifically, the selector 5042 selects the time T1*a*, when the state data ST1 is input, selects the time (TD−T1*a*), when the state data ST2 is input, selects the time T2*a*(1), when the state data ST3 is input, selects the time (TR−T2*a*(1)), when the state data ST4 is input, selects the time T3*a*, when the state data ST5 is input, selects the time (TP−T3*a*), when the state data ST6 is input, and selects the time T4*a*, when the state data ST7 is input. The selector 5042 sets the selected time to the timer 5043.

The timer 5043 measures the time set by the selector 5042. When the measurement of the time is completed, the timer 5043 outputs a state update signal SA to the state counter 5044.

The state counter 5044 is an octal counter and the state data ST is reset to "0" in an initial state. In this state, when a trigger signal for waveform output start is input, the state counter 5044 counts up the state data ST by "1". After that, at each time the state update signal SA is input from the timer 5043, the state counter 5044 counts up the state data ST by "1". When the state data ST is counted to an upper limit value ("7" in the octal counter), the state counter 5044 resets the state data ST as "0" by the input of the state update signal SA after that. The state counter 5044 outputs the state data items ST0 to ST7 to the selector 5042 and the driving pattern memory 5045.

The driving pattern memory 5045 stores driving pattern data by associating the driving pattern data with the state data items ST0 to ST7. The driving pattern data is data for controlling on and off of the six switch elements S11, S12, S13, S21, S22, and S23.

FIG. 23 shows a specific example of the driving pattern data stored in the driving pattern memory 5045. In FIG. 23, a symbol "(−)" attached to the reference numeral of the switch elements S11 and S21 represents that the switch element S11 is connected between left electrode of the actuator Z1 in FIG. 6A and the negative power line L2, and S21 is connected between right electrode of the actuator Z1 in FIG. 6A and the negative power line L2.

A symbol "(+)" attached to the reference numeral of the switch elements S12 and S22 represents that the switch element S12 is connected between left electrode of the actuator Z1 in FIG. 6A and the positive power line L1, and S22 is connected between right electrode of the actuator Z1 in FIG. 6A and the positive power line L1.

A symbol "(0)" attached to the reference numeral of the switch elements S13 and S23 represents that the switch element S13 is connected between left electrode of the actuator Z1 in FIG. 6A and the ground line L3, and S23 is connected between right electrode of the actuator Z1 in FIG. 6A and to the ground line L3.

In this embodiment, right electrode of the actuator Z1 in FIG. 6A is not connected to the left electrode of the actuator Z2.

At each time the state data items ST0 to ST7 are input from the state counter 5044, the driving waveform is generated from the driving pattern memory 5045 for each of the switch elements S11, S12, S13, S21, S22, and S23, according to the driving pattern data corresponding to the state data items ST0 to ST7.

The driving pattern data items corresponding to the state data items ST0 to ST7 shown in FIG. 23 coincide with the driving pattern data-items of the first embodiment. In addition, the selector 5042, the timer 5043, the state counter 5044, and the driving pattern memory 5045 configuring the circuit unit 504 operate in the same manner as the selector 402, the timer 403, the state counter 404, and the driving pattern memory 405 of the first embodiment.

Accordingly, the operation of the waveform generation circuit 500 when the state data is updated to ST0, ST1, and ST2 and when the state data is updated to ST5, ST6, and ST7, coincides with the operation of the waveform generation circuit 400 of the first embodiment.

That is, in the initial state of the state data which is ST0, the switch element S23 and the switch element S13 are turned on, and the switch element S21, the switch element S22, the switch element S11, and the switch element S12 are turned off. When the state data is updated to ST1, the switch element S13 is turned off and then the switch element S12 is turned on. As a result, the actuator Z1 is electrically connected and charged in a forward direction with the voltage E/2 [V], while the former charging time T1*a* is measured. Subsequently, when the state data is updated to ST2, the switch element S23 is turned off and then the switch element S21 is turned on. As a result, the actuator Z1 is electrically connected and charged in a forward direction with the voltage E [V], while the time (TD−T1*a*) is measured. By performing the operation described above, the ink is replenished in the pressure chamber of the channel Ch. 1.

When the state data is updated to ST3, the selector 5042 selects the time adjustment value T2*a*(1). As a result, the timer 5043 measures the time T2*a*(1). The switch element S21 is turned off and then the switch element S23 is turned on according to the driving waveform of the driving pattern data corresponding to the state data ST3. As a result, the actuator Z1 is discharged in a state where the intermediate voltage E/2 [V] is applied thereto, while the time T2*a*(1) is measured.

When the time T2*a*(1) is measured and the state data is updated to ST4, the selector 5042 selects the time (TR−T2*a*(1)). As a result, the timer 5043 measures the time (TR−T2*a*(1)). The switch element S12 is turned off and then the switch element S13 is turned on according to the driving waveform of the driving pattern data corresponding to the state data ST4. As a result, the actuator Z1 is turned into a state where the voltage zero is applied thereto, and continues to be discharged, while the time (TR−T2*a*(1)) is measured. By performing the operation described above, one ink droplet is ejected from the nozzle of the channel Ch. 1, when the printing data D1 of dot output is applied to the gate circuit 5046. The ejecting timing is at the time of the discharging operation.

Accordingly, the time T2*a*(1) functions as the former discharging time described in the first embodiment.

When the state data is updated to ST5, the switch element S23 is turned off and then the switch element S22 is turned on. As a result, the actuator Z1 is electrically connected and charged in a reverse direction with the voltage E/2 [V], while the former contracting time T3*a* is measured. Subsequently, when the state data is updated to ST6, the switch element S13 is turned off and then the switch element S11 is turned on. As a result, the actuator Z1 is electrically connected and charged in a reverse direction with the voltage E [V], while the time (TP−T3*a*) is measured. Subsequently, when the state data is updated to ST7, the switch element S11 is turned off and then the switch element S13 is turned on. As a result, the actuator Z1 is discharged during the former restoration time T4*a*. Subsequently, when the state data is returned to ST0, the switch element S22 is turned off and then the switch element S23 is turned on. As a result, the actuator Z1 continues to be discharged. By performing the operation described above, the capacitance of the pressure chamber of the channel Ch. 1 is expanded and restored and the damping is performed.

In the second embodiment, the former discharging time T2*a*(1) and the subsequent discharging time (TR−T2*a*(1)) at the timing of ejecting the ink from the nozzles are dependent on the time adjustment value T2*a*(1) set in the time adjustment value register 503. That is, the former discharging time T2*a*(1) is decreased by decreasing the time adjustment value T2*a*(1). When the former discharging time T2*a*(1) is decreased, the ejecting speed of the ink ejected from the nozzles increases and the ejection volume of the ink also increases. In contrast, the former discharging time T2*a*(1) is increased by increasing the time adjustment value T2*a*(1). When the former discharging time T2*a*(1) is increased, the ejecting speed of the ink ejected from the nozzles decreases and the ejection volume of the ink also decreases.

As described above, according to the second embodiment, it is possible to provide an ink jet head which can adjust the ejecting characteristics (ejecting speed and ejection volume) of the ink for each of the channels Ch. 1 to Ch. n, while suppressing the power consumption.

Third Embodiment

Figure 24:
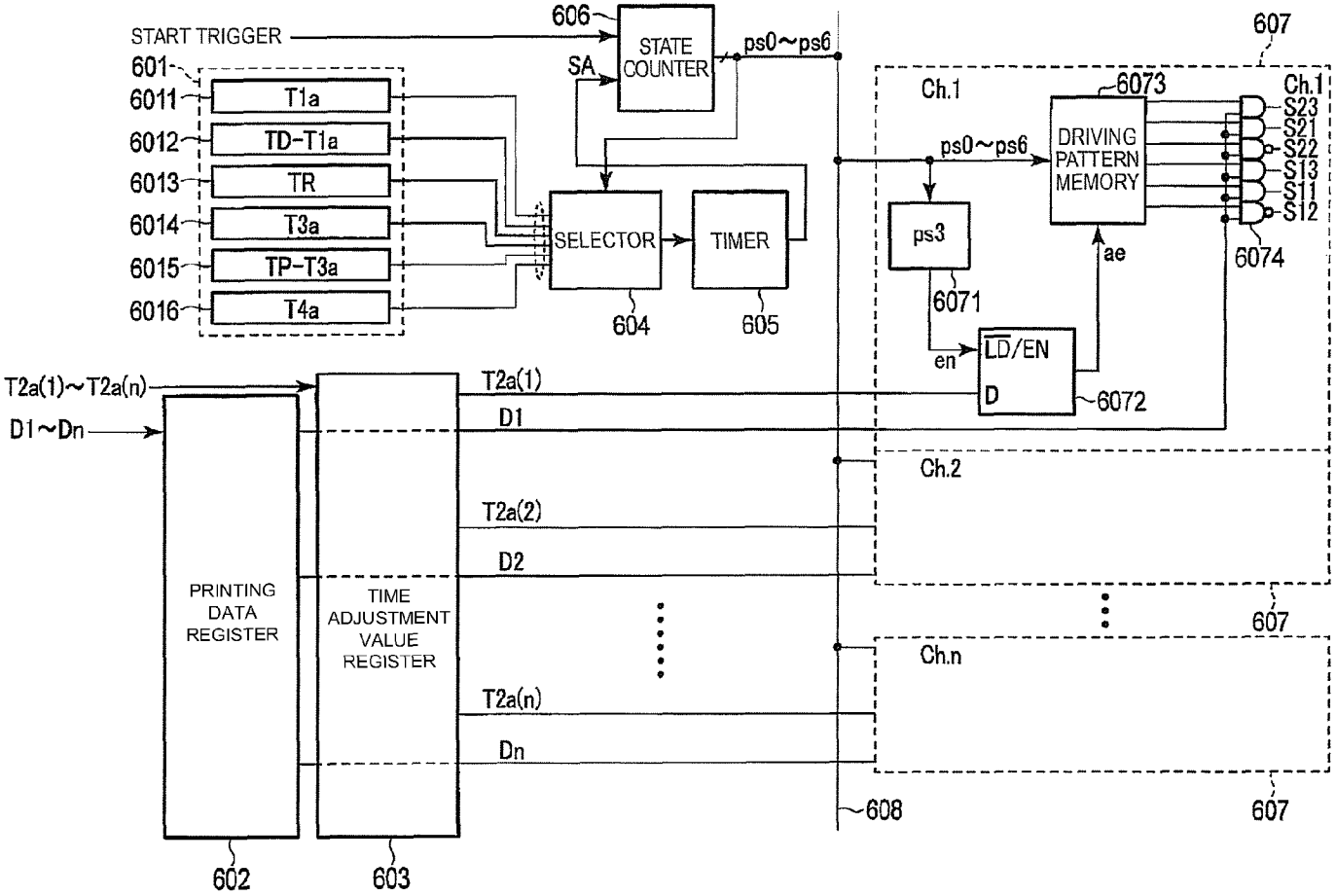
FIG. 24 is a block diagram showing a configuration of a waveform generation circuit of a third embodiment.

FIG. 24 is a block diagram showing a configuration of a waveform generation circuit 600 of the third embodiment. The waveform generation circuit 600 includes a time setting register 601, a printing data register 602, a time adjustment value register 603, a selector 604, a timer 605, and a state counter 606 which are commonly used for channels Ch. 1, Ch. 2, . . . , and Ch. n, a circuit unit 607 for each of the channels Ch. 1, Ch. 2, . . . , and Ch. n, and signal lines 608. The signal lines 608 electrically connect the printing data register 602, the time adjustment value register 603, and the state counter 606 and each circuit unit 607 to each other.

Each circuit unit 607 is a circuit group which generates the driving waveform with respect to the corresponding channel. The driving waveform is a waveform for controlling on and off of the six switch elements which form the electric connection path to the actuator included in the channel. Each circuit unit 607 has the same configuration.

Accordingly, FIG. 24 only shows the specific configuration for the circuit unit 607 with respect to the channel Ch. 1. In addition, a case where the circuit unit 607 applies the driving waveform to the switch elements S11, S12, S13, S21, S22, and S23 will be described. The description regarding the circuit unit 607 with respect to the other channels Ch. 2, . . . , and Ch. n is overlapped, and therefore, the description thereof is omitted herein.

In this embodiment, actuators are channel independent and not shared with neighboring channels.

The time setting register 601 includes a $21^{st}$ setting register 6011, a $22^{nd}$ setting register 6012, a $23^{rd}$ setting register 6013, a $24^{th}$ setting register 6014, a $25^{th}$ setting register 6015, and a $26^{th}$ setting register 6016. A time T1*a* is set in the $21^{st}$ setting register 6011. A time (TD−T1*a*) is set in the $22^{nd}$ setting register 6012. A time TR is set in the $23^{rd}$ setting register 6013. A time T3*a* is set in the $24^{th}$ setting register 6014. A time (TP−T3*a*) is set in the $25^{th}$ setting register 6015. A time T4*a* is set in the $26^{th}$ setting register 6016. The time T1*a*, the time (TD−T1*a*), the time TR, the time T3*a*, the time (TP−T3*a*), and the time T4*a* have the same meaning as the time having the same reference numerals described with reference to FIGS. 8 to 10 in the first embodiment. That is, in the time setting register 601 of the third embodiment, the third setting register 4013 in which the time T2*a* is set and the fourth setting register 4014 in which the time (TR−T2*a*) is set are removed, and the 23rd setting register 6013 in which the time TR is set is added, compared to the time setting register 401 of the first embodiment.

In comparison with the second embodiment, the time setting register 601 has the same configuration as that of the time setting register 501. The printing data register 602 and the time adjustment value register 603 also have the same configuration as those of the printing data register 502 and the time adjustment value register 503 of the second embodiment. Accordingly, the description of the printing data register 602 and the time adjustment value register 603 is omitted.

The selector 604 selects the time T1*a*, the time (TD−T1*a*), the time TR, the time T3*a*, the time (TP−T3*a*), and the time T4*a* set in the 21st setting register 6011 to the 26th setting register 6016, in order, according to state data items ps0 to ps6 output from the state counter 606. Specifically, the selector 604 selects the time T1*a* when the state data ps1 is input, selects the time (TD−T1*a*) when the state data ps2 is input, selects the time TR when the state data ps3 is input, selects the time T3*a* when the state data ps4 is input, selects the time (TP−T3*a*) when the state data ps5 is input, and selects the time T4*a* when the state data ps6 is input. The selector 604 sets the selected time to the timer 605.

The timer 605 measures the time set by the selector 604. When the measurement of the time is completed, the timer 605 outputs a state update signal SA to the state counter 606.

The state counter 606 is a septenary counter and the state data ps is reset to "0" in an initial state. In this state, when a trigger signal for waveform output start is input, the state counter 606 counts up the state data ps by "1". After that, at each time the state update signal SA is input from the timer 605, the state counter 606 counts up the state data ps by "1". When the state data ps is counted to an upper limit value ("6" in the septenary counter), the state counter 606 resets the state data ps as "0" by the input of the state update signal SA after that. The state counter 606 outputs the state data items ps0 to ps6 to the selector 604 and the circuit unit 607 for each of the channels Ch. 1 to Ch. n.

Each circuit unit 607 includes a state detector 6071, a one-shot timer 6072, a driving pattern memory 6073, and a gate circuit 6074. The gate circuit 6074 has the same configuration as that of the gate circuit 5046 of the second embodiment, and therefore, the description herein is omitted.

The state detector 6071 detects the state data ps3 from the state data items ps0 to ps6 applied from the state counter 606. When the state detector 6071 detects the state data ps3, an enable signal en is output to the one-shot timer 6072.

The one-shot timer 6072 receives the time adjustment value T2*a*(1) corresponding to the channel Ch. 1 from the time adjustment value register 603. The one-shot timer 6072 measures the time corresponding to the time adjustment value T2*a*(1), at every time the enable signal en is received from the state detector 6071 and when the measurement is completed, the adjustment completion signal ae is output to the driving pattern memory 6073.

The driving pattern memory 6073 stores driving pattern data by associating the driving pattern data with the state data items ps0 to ps6 and also by associating the driving pattern data with the presence or absence of an adjustment completion signal ae, when the state data is ps3. The driving pattern data is data for controlling on and off of the six switch elements S11, S12, S13, S21, S22, and S23.

Figure 25:
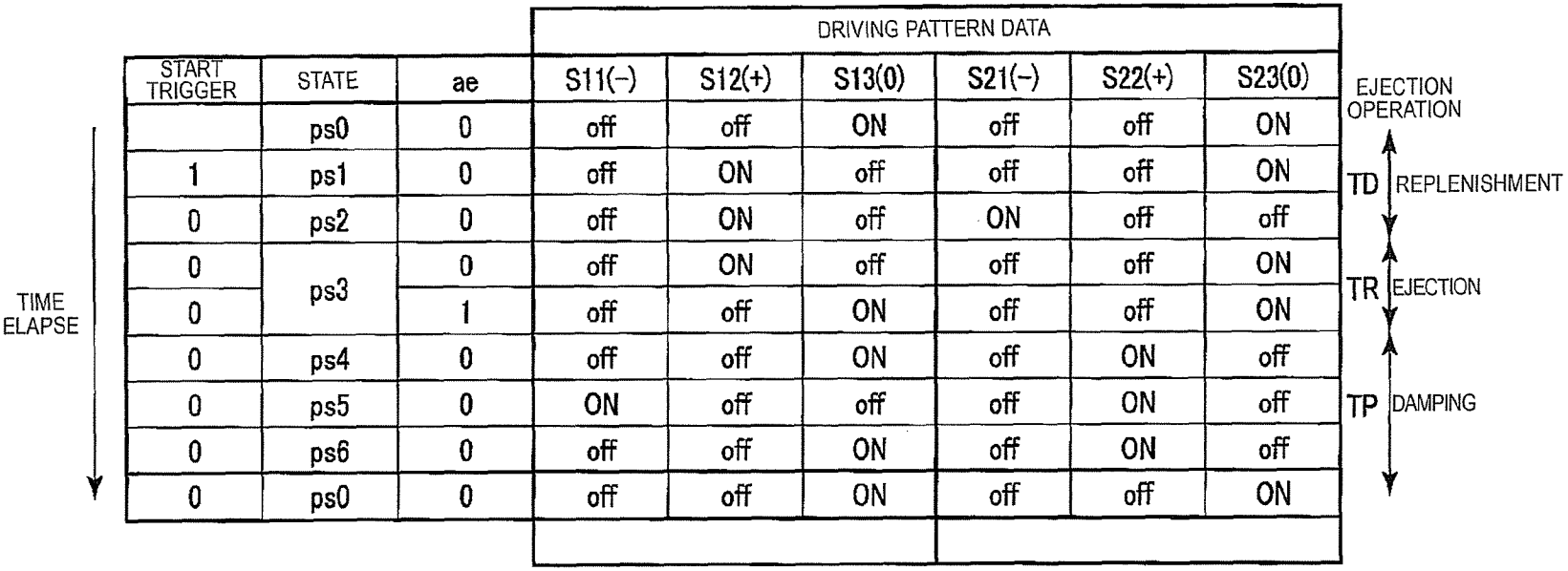
FIG. 25 is a diagram showing a specific example of driving pattern data stored in a driving pattern memory in the third embodiment.

FIG. 25 shows a specific example of the driving pattern data stored in the driving pattern memory 6073. In FIG. 25, a symbol "(−)" attached to the reference numeral of the switch elements S11 and S21 represents that the switch elements S11 and S21 are connected to the negative power line L2. A symbol "(+)" attached to the reference numeral of the switch elements S12 and S22 represents that the switch elements S12 and S22 are connected to the positive power line L1. A symbol "(0)" attached to the reference numeral of the switch elements S13 and S23 represents that the switch elements are connected to the ground line L3.

At each time the state data items ps0 to ps6 are input from the state counter 606, the driving waveform is generated from the driving pattern memory 6073 for each of the switch elements S11, S12, S13, S21, S22, and S23, according to the driving pattern data items which correspond to the state data items ps0 to ps6, and are also associated with the presence or absence of an adjustment completion signal ae when the state data is ps3.

In the initial state of the state data which is ps0, the switch elements S11, S12, S21, and S22 are turned off, and the switch element S13 and the switch element S23 are turned on.

When a trigger signal for waveform output start is input to the state counter 606 and the state data is updated to ps1, the driving fluctuation occurs so that the switch element S13 is turned off and then the switch element S12 is turned on. In the meanwhile, the selector 604 selects the former charging time T1*a* set in the 21st setting register 6011, and sets the time to the timer 605. As a result, the actuator Z1 is electrically connected and charged in a forward direction with the voltage E/2 [V], while the former charging time T1*a* is measured.

When the state data is updated to ps2 by measuring the time T1*a* by the timer 605, the switch element S23 is turned off and then the switch element S21 is turned on. In the meanwhile, the selector 604 selects the time (TD−T1*a*) set in the 22nd setting register 6012 and sets the time to the timer 605. As a result, the actuator Z1 is electrically connected and charged in a forward direction with the voltage E [V], while the time (TD−T1*a*) is measured. By performing the operation described above, the ink is replenished in the pressure chamber of the channel Ch. 1.

When the state data is updated to ps3 by measuring the time (TD−T1*a*) by the timer 605, the switch element S21 is turned off and then the switch element S23 is turned on. In the meanwhile, the selector 604 selects the time TR set in the 23rd setting register 6013 and sets the time to the timer 605. The one-shot timer 6072 is activated by detecting the state data ps3 by the state detector 6071. When the one-shot timer 6072 measures the time T2*a*(1), the adjustment completion signal ae is output to the driving pattern memory 6073.

As a result, the actuator Z1 is firstly discharged in a state where the intermediate voltage E/2 [V] is applied thereto, while the time T2*a*(1) is measured. When the time T2*a*(1) is measured and the adjustment completion signal ae is input to the driving pattern memory 6073, the switch element S12 is turned off and the switch element S13 is turned on. As a result, the actuator Z1 is turned into a state where the voltage zero is applied thereto, and continues to be discharged, while the time (TR−T2*a*(1)) is measured. By performing the operation described above, one ink droplet is ejected from the nozzle of the channel Ch. 1, as long as the printing data D1 of dot output is applied to the gate circuit 6074. The ejecting timing is at the time of the discharging operation.

When the state data is updated to ps4 by measuring the time TR by the timer 605, the switch element S23 is turned off and the switch element S22 is turned on. In the meanwhile, the selector 604 selects the time T3*a* set in the 24th setting register 6014 and sets the time to the timer 605. As a result, the actuator Z1 is electrically connected and charged in the reverse direction with the voltage E/2 [V], while the time set in the 24th setting register 6014, that is, the former reverse charging time T3*a* is measured.

When the state data is updated to ps5 by measuring the time T3*a* by the timer 605, the switch element S13 is turned off and the switch element S11 is turned on. In the meanwhile, the selector 604 selects the time (TP−T3*a*) set in the $25^{th}$ setting register 6015 and sets the time to the timer 605. As a result, the actuator Z1 is electrically connected and charged in a reverse direction with the voltage E [V], while the time (TP−T3*a*) is measured.

When the state data is updated to ps6 by measuring the time (TP−T3*a*) by the timer 605, the switch element S11 is turned off and the switch element S13 is turned on. In the meanwhile, the selector 604 selects the time T4*a* set in the $26^{th}$ setting register 6016 and sets the time to the timer 605. As a result, the actuator Z1 is discharged with the voltage E/2 [V], during the time set in the $26^{th}$ setting register 6016, that is, the former reverse discharging time T4*a*.

When the state data is returned to ps0 by measuring the time T4*a* by the timer 605, the switch element S22 is turned off and the switch element S23 is turned on. As a result, the actuator Z1 is turned into a state where the voltage zero is applied thereto, and discharging of the actuator Z1 is continued. By performing the operation described above, the capacitance of the pressure chamber of the channel Ch. 1 is expanded and restored and the damping is performed.

As described above, in the third embodiment, the former discharging time T2*a*(1) and the subsequent discharging time (TR−T2*a* (1)) at the timing of ejecting the ink from the nozzles are dependent on the time adjustment value T2*a*(1) set in the time adjustment value register 603. The time adjustment value T2*a*(1) to T2*a*(*n*) can be different values each other. Accordingly, in the same manner as in the second embodiment, it is possible to provide an ink jet head which can adjust the ejecting characteristics of the ink for each of the channels Ch. 1 to Ch. n, while suppressing the power consumption.

In addition, in the waveform generation circuit 600, the selector 604, the timer 605, and the state counter 606 generating the timing of the driving deformation are set to be commonly used for channels Ch. 1 to Ch. n. Accordingly, the circuit unit 607 has a small number of configuration components, compared to the circuit unit 504 of the second embodiment, and therefore, effects of a simple configuration and low cost are obtained. Such effects are significant, as the ink jet head has a large number of channels.

In both of the second and third embodiments, a case of adjusting the ejecting characteristics of the ink for each of the channels Ch. 1 to Ch. n is exemplified. The adjustment of the ejecting characteristics is not limited to being performed for each of the channels Ch. 1 to Ch. n. The ejecting characteristics of the ink may be adjusted for all of the channels Ch. 1 to Ch. n. In addition, it is possible to reduce the circuit scale and to realize low cost, by adjusting the ejecting characteristics of the ink in a group unit by setting the plurality of channels as a group.

Hereinafter, the embodiments (fourth and fifth embodiments) of the ink jet head which can adjustably set the ejection characteristics of the ink in the group unit will be described.

Fourth Embodiment

Figure 26:
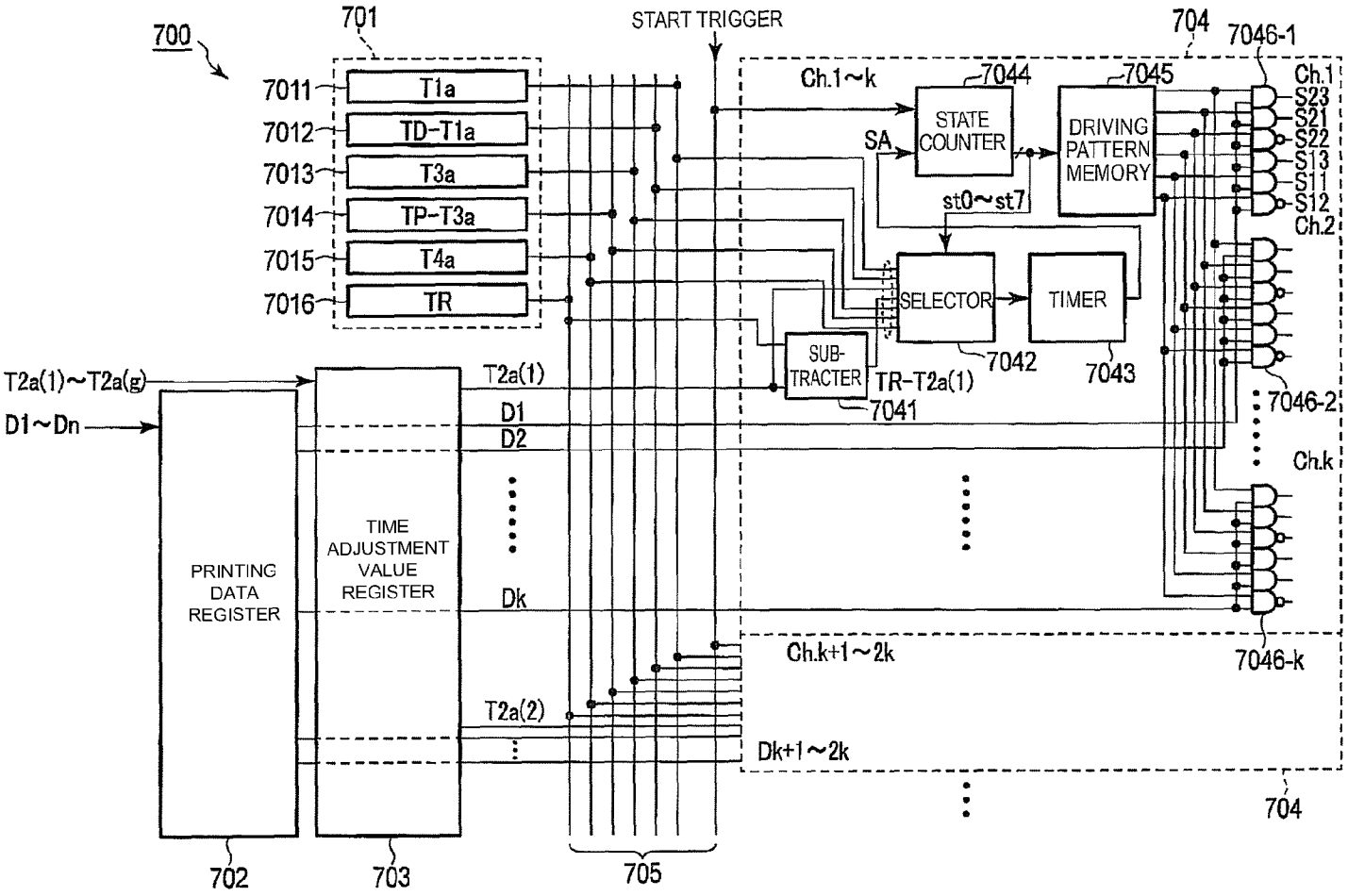
FIG. 26 is a block diagram showing a configuration of a waveform generation circuit of a fourth embodiment.

FIG. 26 is a block diagram showing a configuration of a waveform generation circuit 700 of the fourth embodiment. The waveform generation circuit 700 includes a time setting register 701, a printing data register 702, and a time adjustment value register 703 which are commonly used for channels Ch. 1 to k, Ch. k+1 to 2k, . . . in the group unit, a circuit unit 704 for each of the channels Ch. 1 to k, Ch. k+1 to 2k, . . . in the group unit, and signal lines 705. The signal lines 705 electrically connect the time setting register 701, the printing data register 702, and the time adjustment value register 703, and each circuit unit 704 to each other.

Each circuit unit 704 is a circuit group which generates the driving waveform with respect to the plurality of channels belonging to the same group. The driving waveform is a waveform for controlling on and off of the six switch elements which form the electric connection path to the actuator included in the channel. Each circuit unit 704 has the same configuration. Accordingly, FIG. 26 only shows the specific configuration for the circuit unit 704 with respect to the one group of the channels Ch. 1 to Ch. k. In addition, a case where the circuit unit 704 applies the driving waveform to the six switch elements in the each channel of Ch. 1 to Ch. k will be described. The description regarding the circuit unit 704 with respect to the other channels Ch. k+1 to 2k, . . . is overlapped, and therefore, the description thereof is omitted herein. In this embodiment, actuators are channel independent and not shared with neighboring channels.

The time setting register 701 includes a $31^{st}$ setting register 7011, a $32^{nd}$ setting register 7012, a $33^{rd}$ setting register 7013, a $34^{th}$ setting register 7014, a $35^{th}$ setting register 7015, and a $36^{th}$ setting register 7016. A time T1*a* is set in the $31^{st}$ setting register 7011. A time (TD−T1*a*) is set in the $32^{nd}$ setting register 7012. A time T3*a* is set in the $33^{rd}$ setting register 7013. A time (TP−T3*a*) is set in the $34^{th}$ setting register 7014. A time T4*a* is set in the $35^{th}$ setting register 7015. A time TR is set in the $36^{th}$ setting register 7016. The time T1*a*, the time (TD−T1*a*), the time T3*a*, the time (TP−T3*a*), the time T4*a*, and the time TR have the same meaning as the time having the same reference numerals described with reference to FIGS. 8 to 10 in the first embodiment. That is, the time setting register 701 of the fourth embodiment is the same as the time setting register 501 of the second embodiment.

The printing data register 702 receives input of printing data items D1 to Dn. The printing data items D1 to Dn correspond to the channels Ch. 1 to Ch. n one by one. The printing data register 702 stores the printing data items D1 to Dn transported from the image memory. The printing data register 702 outputs the printing data items D1 to Dn to the circuit unit 704 to which the corresponding channels Ch. 1 to Ch. n belong, by a first-in first-out (FIFO) method.

The time adjustment value register 703 receives input of time adjustment values T2*a*(1) to T2*a*(*g*). All of the time adjustment values T2*a*(1) to T2*a*(*g*) are times required for discharging the actuator to the intermediate voltage E/2 [V] at the time of first discharging. The time adjustment values T2*a*(1) to T2*a*(*g*) correspond to the group including the plurality of channels one by one. The time adjustment values T2*a*(1) to T2*a*(*g*) can be set as arbitrary values for each of the groups. The time adjustment value register 703 stores the time adjustment values T2*a*(1) to T2*a*(*g*) set for each of the groups. The time adjustment value register 703 outputs the time adjustment values T2*a*(1) to T2*a*(*g*) to the circuit unit 704 of the corresponding groups.

The signal lines 705 connect the $31^{st}$ to $36^{th}$ setting registers 7011 to 7016 of the time setting register 701, the printing data register 702, and the time adjustment value register 703 to each circuit unit 704. In addition, the signal lines 705 apply a trigger signal for waveform output start to each circuit unit 704.

Each circuit unit 704 includes a subtracter 7041, a selector 7042, a timer 7043, a state counter 7044, a driving pattern memory 7045, and gate circuits 7046-1, 7046-2, . . . , and 7046-*k* for each of the channels Ch. 1 to Ch. k belonging to the group. Each of the gate circuits 7046-1, 7046-2, . . . , and **7046-*k* includes 2 input AND gate or NAND gate corresponding to the six switch elements. The gate circuits 7046-1, 7046-2, . . . , and 7046-*k* are set as the AND gates with respect to the switch elements which are formed of the N-type channel MOS transistors connected to the negative power line L2 and connected to the ground line L3. The gate circuits 7046-1, 7046-2, . . . , and 7046-*k* are set as the NAND gates with respect to the switch elements which are formed of the P-type channel MOS transistors and connected to the positive power line L1. The printing data items D1 to Dk output from the printing data register 702 are applied to the input performed through one of the AND gate and the NAND gate of the gate circuits 7046-1, 7046-2, . . . , and 7046-*k*. The driving waveform generated for each of the switch elements from the driving pattern memory 7045** is applied to the other input performed through one of the AND gate and the NAND gate.

The subtracter 7041, the selector 7042, the timer 7043, the state counter 7044, and the driving pattern memory 7045 are the same as the subtracter 5041, the selector 5042, the timer 5043, the state counter 5044, and the driving pattern memory 5045 of the second embodiment. The driving pattern data stored in the driving pattern memory 7045 is also the same as that in the second embodiment shown in FIG. 23.

Accordingly, when a trigger signal for waveform output start is input to the state counter 7044 and the state data is updated to ST1 from ST0, the actuators Z1 to Zk of the channels Ch. 1 to Ch. k are electrically connected and charged in a forward direction with the voltage E/2 [V], while the former charging time T1*a* is measured as long as the corresponding print data D1 to Dk being enabled. Subsequently, when the state data is updated to ST2, the actuators Z1 to Zk are electrically connected and charged in a forward direction with the voltage E [V], while the time (TD−T1*a*) is measured as long as the corresponding print data D1 to Dk being enabled. By performing the operation described above, the ink is replenished in the pressure chamber of the channels Ch. 1 to Ch. k.

Subsequently, when the state data is updated to ST3, the actuators Z1 to Zk are discharged in a state where the intermediate voltage E/2 [V] is applied thereto, while the former discharging time T2*a*(1) is measured as long as the corresponding print data D1 to Dk being enabled. When the time T2*a*(1) is measured and the state data is updated to ST4, the actuators Z1 to Zk are turned into a state where the voltage zero is applied thereto, and continue to be discharged, while the time (TR−T2*a*(1)) is measured as long as the corresponding print data D1 to Dk being enabled. By performing the operation described above, one ink droplet is ejected from the nozzles of the channel Ch. 1 to Ch. k, as long as the printing data items D1 to Dk of dot output is applied to the gate circuits 7046-1 to **7046-*k***. The ejecting timing is at the time of the discharging operation.

Subsequently, when the state data is updated to ST5, the actuators Z1 to Zk are electrically connected and charged in the reverse direction with the voltage E/2 [V], while the former contracting time T3*a* is measured as long as the corresponding print data D1 to Dk being enabled. Subsequently, when the state data is updated to ST6, the actuators Z1 to Zk are electrically connected and charged in a reverse direction with the voltage E [V], while the time (TP−T3*a*) is measured as long as the corresponding print data D1 to Dk being enabled. Subsequently, when the state data is updated to ST7, the actuators Z1 to Zk are discharged in a state where the intermediate voltage E/2 [V] is applied thereto, while the former restoration time T4*a* is measured as long as the corresponding print data D1 to Dk being enabled. When the state data is returned to ST0, the actuators Z1 to Zk continue to be discharged. By performing the operation described above, the capacitance of the pressure chamber of the channels Ch. 1 to Ch. k is expanded and restored and the damping is performed as long as the corresponding print data D1 to Dk being enabled.

As described above, according to the fourth embodiment, it is possible to provide an ink jet head which can adjust the ejecting characteristics (ejecting speed and ejection volume) of the ink in the group unit including the plurality of channels, while suppressing the power consumption.

Fifth Embodiment

Figure 27:
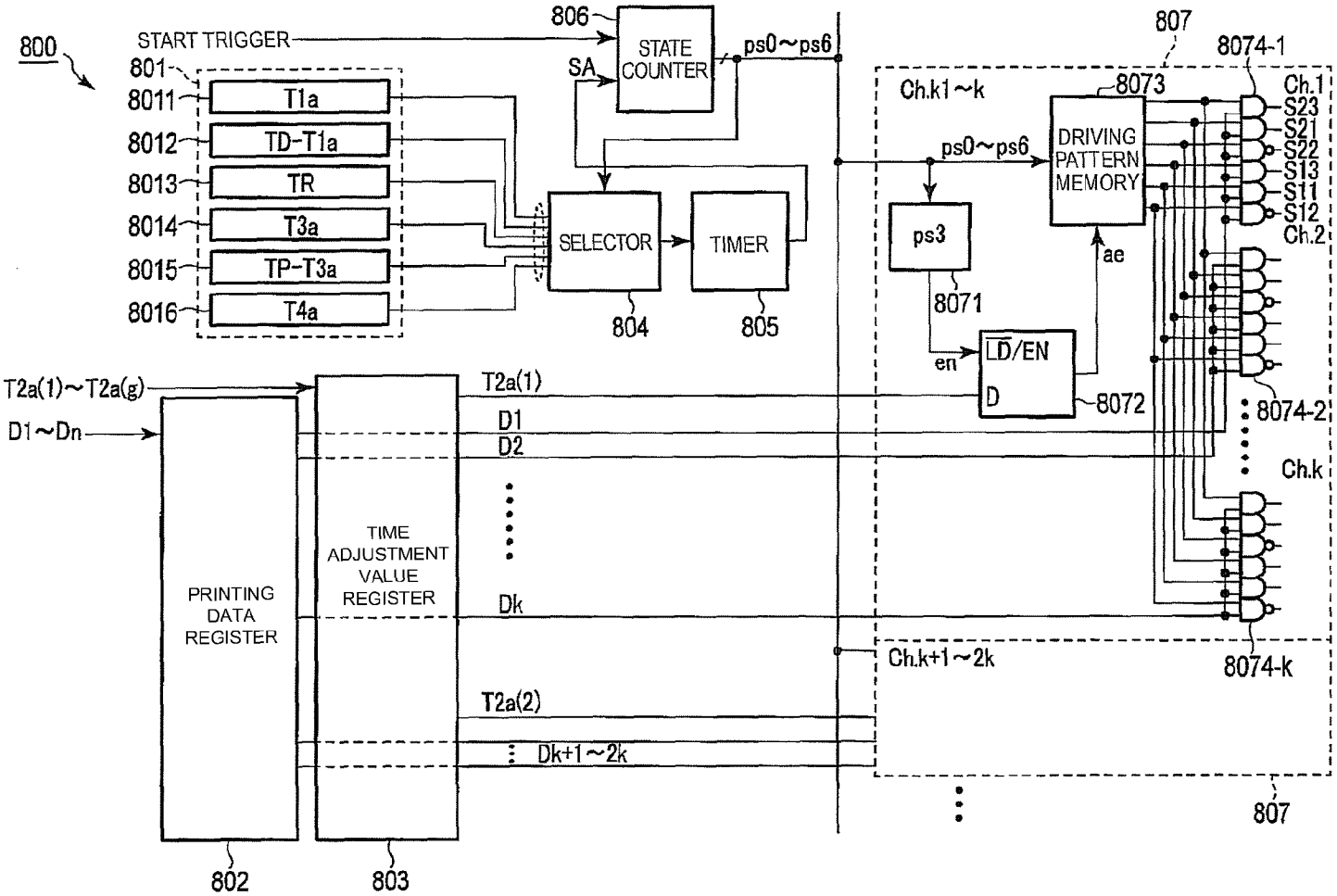
FIG. 27 is a block diagram showing a configuration of a waveform generation circuit of a fifth embodiment.

FIG. 27 is a block diagram showing a configuration of a waveform generation circuit 800 of the fifth embodiment. The waveform generation circuit 800 includes a time setting register 801, a printing data register 802, a time adjustment value register 803, a selector 804, a timer 805, and a state counter 806 which are commonly used for channels Ch. 1 to k, Ch. k+1 to 2k, . . . in the group unit, a circuit unit 807 for each of the channels Ch. 1 to k, Ch. k+1 to 2k, . . . in the group unit, and signal lines 808. The signal lines 808 electrically connect the printing data register 802, the time adjustment value register 803, the state counter 806, and the circuit unit 807.

Each circuit unit 807 is a circuit group which generates the driving waveform with respect to the plurality of channels belonging to the same group. The driving waveform is a waveform for controlling on and off of the six switch elements which form the electric connection path to the actuator included in the channel. Each circuit unit 807 has the same configuration. Accordingly, FIG. 27 only shows the specific configuration for the circuit unit 807 with respect to the one group of the channels Ch. 1 to Ch. k. In addition, a case where the circuit unit 807 applies the driving waveform to the six switch elements in the each channel of Ch. 1 to Ch. k will be described. The description regarding the circuit unit 807 with respect to the other channels Ch. k+1 to 2k, . . . is overlapped, and therefore, the description thereof is omitted herein. In this embodiment, actuators are channel independent and not shared with neighboring channels.

The time setting register 801 includes a $41^{st}$ setting register 8011, a $42^{nd}$ setting register 8012, a $43^{rd}$ setting register 8013, a $44^{th}$ setting register 8014, a $45^{th}$ setting register 8015, and a $46^{th}$ setting register 8016. A time T1*a* is set in the $41^{st}$ setting register 8011. A time (TD−T1*a*) is set in the $42^{nd}$ setting register 8012. A time TR is set in the $43^{rd}$ setting register 8013. A time T3*a* is set in the $44^{th}$ setting register 8014. A time (TP−T3*a*) is set in the $45^{th}$ setting register 8015. A time T4*a* is set in the $46^{th}$ setting register 8016. The time T1*a*, the time (TD−T1*a*), the time TR, the time T3*a*, the time (TP−T3*a*), and the time T4*a* have the same meaning as the time having the same reference numerals described with reference to FIGS. 8 to 10 in the first embodiment.

That is, the time setting register 801 of the fifth embodiment is the same as the time setting register 601 of the third embodiment. The selector 804, the timer 805, and the state counter 806 are also the same as the selector 604, the timer 605, and the state counter 606 of the third embodiment. The printing data register 802 and the time adjustment value register 803 have the same configuration as those of the printing data register 702 and the time adjustment value register 703 of the fourth embodiment. Accordingly, the description of the printing data register 802, the time adjustment value register 803, the selector 804, the timer 805, and the state counter 806 is omitted.

Each circuit unit 807 includes a state detector 8071, a one-shot timer 8072, a driving pattern memory 8073, and gate circuits 8046-1, 8046-2, . . . , and **8046-*k* for each of the channels Ch. 1 to Ch. k belonging to the group. Each of the gate circuits 8046-1, 8046-2, . . . , and 8046-*k* has the same configuration as that in the fourth embodiment, and therefore, the description herein is omitted. The state detector 8071, the one-shot timer 8072, and the driving pattern memory 8073 are the same as the state detector 6071, the one-shot timer 6072, and the driving pattern memory 6073 of the third embodiment. The driving pattern data stored in the driving pattern memory 8073 is also the same as that in the third embodiment shown in FIG. 25**.

Accordingly, when a trigger signal for waveform output start is input to the state counter 806 and the state data is updated to ps1 from ps0, the actuators Z1 to Zk of the channels Ch. 1 to Ch. k are electrically connected and charged in a forward direction with the voltage E/2 [V], while the former charging time T1*a* is measured as long as the corresponding print data D1 to Dk being enabled. Subsequently, when the state data is updated to ps2, the actuators Z1 to Zk are electrically connected and charged in a forward direction with the voltage E [V], while the time (TD−T1*a*) is measured as long as the corresponding print data D1 to Dk being enabled. By performing the operation described above, the ink is replenished in the pressure chamber of the channels Ch. 1 to Ch. k.

Subsequently, when the state data is updated to ps3, the actuators Z1 to Zk are firstly discharged in a state where the intermediate voltage E/2 [V] is applied thereto, while the time T2*a*(1) is measured as long as the corresponding print data D1 to Dk being enabled. When the time T2*a*(1) is measured and the adjustment completion signal ae is input to the driving pattern memory 8073, the actuators Z1 to Zk are turned into a state where the voltage zero is applied thereto, and continue to be discharged, while the time (TR−T2*a*(1)) is measured as long as the corresponding print data D1 to Dk being enabled. By performing the operation described above, one ink droplet is ejected from the nozzles of the channel Ch. 1 to Ch. k, as long as the printing data items D1 to Dk of dot output is applied to the gate circuits 8046-1 to **8046-*k***. The ejecting timing is at the time of the discharging operation.

Subsequently, when the state data is updated to ps4, the actuators Z1 to Zk are electrically connected and charged in the reverse direction with the voltage E/2 [V], while the former contracting time T3*a* is measured as long as the corresponding print data D1 to Dk being enabled. Subsequently, when the state data is updated to ps5, the actuators Z1 to Zk are electrically connected and charged in a reverse direction with the voltage E [V], while the time (TP−T3*a*) is measured as long as the corresponding print data D1 to Dk being enabled. Subsequently, when the state data is updated to ps6, the actuators Z1 to Zk are discharged in a state where the intermediate voltage E/2 [V] is applied thereto, during the former restoration time T4*a* as long as the corresponding print data D1 to Dk being enabled. When the state data is returned to ps0, the actuators Z1 to Zk continue to be discharged. By performing the operation described above, the capacitance of the pressure chamber of the channels Ch. 1 to Ch. k is expanded and restored and the damping is performed.

As described above, according to the fifth embodiment, it is possible to provide an ink jet head which can adjust the ejecting characteristics (ejecting speed and ejection volume) of the ink in the group unit including the plurality of channels, while suppressing the power consumption, in the same manner as in the fourth embodiment. In addition, the circuit unit 807 has the small number of configuration components, compared to the circuit unit 704 of the fourth embodiment, and therefore, effects of a simple configuration and low cost are obtained. Such effects are significant, as the ink jet head has a large number of channels.

Modification Example

In the first embodiment described above, the share mode type ink jet head 100 is exemplified, but the exemplary embodiment can be applied to a type which operates only one actuator when ejecting the ink from one nozzle, that is, an ink jet head other than the share mode type, in the same manner. In this case, in FIG. 6, for example, the actuator Z1 may be treated as an actuator which operates when ejecting the ink from one nozzle.

In the second to fifth embodiment described above, actuators are channel independent and not shared with neighboring channels, but the exemplary embodiment can be applied to a type which actuators are shared with neighboring channels.

In the embodiments described above, the replenishment and the ejection of the ink are performed by applying the negative polarity voltage to the actuator and the damping is performed by applying the positive polarity voltage to the actuator, but the polarity of the voltage applied to the actuator may be reversed at the time of the replenishment and the ejection of the ink and at the time of the damping. That is, the replenishment and the ejection of the ink can be performed by applying the positive polarity voltage to the actuator and the damping can be performed by applying the negative polarity voltage to the actuator.

In the embodiments described above, the waveform generation circuit includes the time setting register, but the time setting register may be removed from the constituent elements of the waveform generation circuit. For example, in a case of the first embodiment, the waveform generation circuit 400 may be configured with the selector 402, the timer 403, the state counter 404, and the driving pattern memory 405, and the time setting register 401 may be provided in an external memory of the waveform generation circuit 400, so that the selector 402 makes a request for the time corresponding to the state data with respect to the setting register 401.

In addition, exemplary embodiments have been described, but the exemplary embodiments are merely examples and are not intended to limit the scope of the exemplary embodiments. The novel embodiments can be executed in various forms, and various omissions, replacements, and modifications can be made in a range not departing from the gist of the exemplary embodiments. These embodiments or the modification thereof are included in the scope or the gist of the exemplary embodiments and are included in the exemplary embodiments disclosed in claims or the equivalent range.

What is claimed is:

1. An ink jet head comprising:

a pressure chamber which is filled with ink;

a capacitive-type actuator which changes capacitance of the pressure chamber by performing charging or discharging with a series of charging and discharging sequence;

a plate having a plurality of nozzles which eject ink in the pressure chamber according to the change of the capacitance of the pressure chamber;

a charging and discharging circuit which selectively charges or discharges the actuator depending on the input driving waveform; and a waveform generation circuit which outputs a driving waveform to the charging and discharging circuit so as to perform charging by applying an intermediate voltage lower than a driving voltage which is a target voltage and then perform charging by applying the driving voltage to the actuator, when charging the actuator, and to perform discharging by applying the intermediate voltage and then perform discharging by applying a zero voltage to the actuator which is charged by the driving voltage, when discharging the actuator, wherein the time for applying the intermediate voltage to the actuator at a timing of ejecting the ink from the nozzles is shorter than the time for applying the intermediate voltage to the actuator at other timings.

2. The ink jet head according to claim 1, wherein the actuator is discharged at the timing of ejecting.

3. An ink jet head comprising:

a pressure chamber which is filled with ink;

a capacitive-type actuator which changes capacitance of the pressure chamber by performing charging or discharging with a series of charging and discharging sequences;

a plate having a plurality of nozzles which eject ink in the pressure chamber according to the change of the capacitance of the pressure chamber;

a charging and discharging circuit which selectively charges or discharges the actuator depending on the input driving waveform; and a waveform generation circuit which outputs a driving waveform to the charging and discharging circuit so as to perform charging by applying an intermediate voltage lower than a driving voltage which is a target voltage and then perform charging by applying the driving voltage to the actuator, when charging the actuator, and to perform discharging by applying the intermediate voltage, then perform discharging by applying a zero voltage, and to perform the charging and discharging in the order of first charging, first discharging, second charging, and second discharging, to the actuator which is charged by the driving voltage, when discharging the actuator, wherein the ink is ejected at a timing of the first discharging, and at least any of T1*a*, T3*a*, and T4*a* is longer than T2*a*, when time for applying the intermediate voltage to the actuator at the time of the first charging is set as T1*a*, time for applying the intermediate voltage to the actuator at the time of the first discharging is set as T2*a*, time for applying the intermediate voltage to the actuator at the time of the second charging is set as T3*a*, and the time for applying the intermediate voltage to the actuator at the time of the second discharging is set as T4*a*.

4. The ink jet head according to claim 3, further comprising:

a time setting register which sets the T1*a*, T2*a*, T3*a*, and T4*a*, wherein the time set in a time setting register of T2*a* is half or shorter, with respect to the time set in at least any time setting register of the time setting registers of T1*a*, T3*a*, and T4*a*.

5. The ink jet head according to claim 4, wherein the waveform generation circuit includes a selector which at least selects a set time from the time setting register, a timer which measures the set time selected by the selector, and a state counter which updates state data at each time the set time is measured by the timer, and a driving waveform corresponding to the state data is output to the charging and discharging circuit.

6. The ink jet head according to claim 1, further comprising:

a power circuit in which a first voltage source and a second voltage source outputting a voltage which is half of the driving voltage, are connected in series and a connected point of the first voltage source and the second voltage source is grounded.

7. An ink jet head comprising:

a pressure chamber which is filled with ink;

a capacitive-type actuator which changes capacitance of the pressure chamber by performing charging or discharging with a series of charging and discharging sequences;

a plate having a plurality of nozzles which eject ink in the pressure chamber according to the change of the capacitance of the pressure chamber;

a charging and discharging circuit which selectively charges or discharges the actuator depending on the input driving waveform;

a waveform generation circuit which outputs a driving waveform to the charging and discharging circuit so as to perform charging by applying an intermediate voltage lower than a driving voltage which is a target voltage and then perform charging by applying the driving voltage to the actuator, when charging the actuator, and to perform discharging by applying the intermediate voltage and then perform discharging by applying a zero voltage to the actuator which is charged by the driving voltage, when discharging the actuator; and an adjustment unit which changes time for applying the intermediate voltage.

8. The ink jet head according to claim 7, wherein the adjustment unit adjusts the time required for discharging the actuator which is charged to the driving voltage at the timing of ejecting the ink from nozzles to the intermediate voltage, for each nozzle or for each group to which the plurality of nozzles belong.

* * * * *